US010870560B2

(12) United States Patent
Fukumori et al.

(10) Patent No.: US 10,870,560 B2
(45) Date of Patent: Dec. 22, 2020

(54) CRANE

(71) Applicant: TADANO LTD., Kagawa (JP)

(72) Inventors: Yasuhiro Fukumori, Kagawa (JP); Naoto Kawabuchi, Kagawa (JP); Naofumi Yoshida, Kagawa (JP)

(73) Assignee: TADANO LTD., Kagawa (JP)

( * ) Notice: Subject to any disclaimer, the term of this patent is extended or adjusted under 35 U.S.C. 154(b) by 276 days.

(21) Appl. No.: 16/090,416

(22) PCT Filed: Apr. 7, 2017

(86) PCT No.: PCT/JP2017/014552
§ 371 (c)(1),
(2) Date: Oct. 1, 2018

(87) PCT Pub. No.: WO2017/175863
PCT Pub. Date: Oct. 12, 2017

(65) Prior Publication Data

US 2019/0119080 A1 Apr. 25, 2019

(30) Foreign Application Priority Data

Apr. 8, 2016 (JP) ..... 2016-078497

(51) Int. Cl.
*B66C 15/06* (2006.01)
*B66C 15/00* (2006.01)
(Continued)

(52) U.S. Cl.
CPC ..... *B66C 15/065* (2013.01); *B66C 15/00* (2013.01); *B66C 23/90* (2013.01); *B66C 23/905* (2013.01);
(Continued)

(58) Field of Classification Search
CPC ..... B66C 15/00; B66C 15/065; B66C 23/54; B66C 23/90; B66C 23/905; B66C 2700/0357; B66D 1/58
See application file for complete search history.

(56) References Cited

U.S. PATENT DOCUMENTS 3,033,399 A * 5/1962 Conner ..... B66C 3/125 212/286
3,315,820 A * 4/1967 Stauffer ..... B66C 23/705 212/288
3,726,417 A * 4/1973 Nephew ..... B66C 13/18 212/288

FOREIGN PATENT DOCUMENTS

JP 2007-204266 A 8/2007

OTHER PUBLICATIONS

Jul. 11, 2017, International Search Report issued for related PCT application No. PCT/JP2017/014552.
(Continued)

*Primary Examiner* — Michael R Mansen
*Assistant Examiner* — Juan J Campos, Jr.
(74) *Attorney, Agent, or Firm* — Paratus Law Group, PLLC

(57) ABSTRACT

Provided is a crane capable of allowing an operator to recognize an error in work information or in a number of windings set in a safety device. A main tension of a main wire rope is calculated from a main output torque of a main winch, a sub output torque of a sub winch, a main drum winding radius of the main winch, and a sub drum winding radius of the sub winch. An estimated hanging load, which is calculated from the main tension, a sub tension of a sub wire rope and the number of windings of the wire rope set in a safety device, is compared with an actual hanging load calculated from fluctuating thrust force and boom informa-
(Continued)

tion. Thus, the suitability of a work kind or a winding number set in the safety device is determined.

5 Claims, 14 Drawing Sheets

(51) Int. Cl.
*B66C 23/90* (2006.01)
*B66C 23/00* (2006.01)

(52) U.S. Cl.
CPC ..... *B66C 23/54* (2013.01); *B66C 2700/0357* (2013.01)

(56) References Cited

OTHER PUBLICATIONS

Jul. 11, 2017, International Search Opinion issued for related PCT application No. PCT/JP2017/014552.

* cited by examiner

CRANE

CROSS REFERENCE TO PRIOR APPLICATION

This application is a National Stage Patent Application of PCT International Patent Application No. PCT/JP2017/014552 (filed on Apr. 7, 2017) under 35 U.S.C. § 371, which claims priority to Japanese Patent Application No. 2016-078497 (filed on Apr. 8, 2016), which are all hereby incorporated by reference in their entirety.

TECHNICAL FIELD

The present invention relates to a crane, particularly to a crane that allows an operator to recognize erroneous settings of the work type of the crane and the number of turns around a sheave in a safety apparatus of the crane.

BACKGROUND ART

Conventionally, in cranes, a safety apparatus is provided to prevent falling of the crane and to prevent overloading of the wire rope. In a crane, the performance of the crane itself is changed according to the work content set in the safety apparatus and the number of turns around a sheave. In other words, such falling and overloading of the wire rope are prevented as long as the crane operates according to the work content set in the safety apparatus and the set number of turns around the sheave. An example is described in PTL 1.

The overload prevention apparatus (safety apparatus) of the crane described in PTL 1 includes a winding number setting apparatus that sets a first number of turns and a second number of turns of a hook rope (wire rope). Further, the overload prevention apparatus stores rated load characteristics and working limit which are the performance of the crane according to the first number of turns and the second number of turns. Furthermore, the overload prevention apparatus includes a switch for fixation of one of the first number of turns and the second number of turns. With such a configuration, the overload prevention apparatus prevents erroneous setting of the number of turns.

The technique described in PTL 1 is used to avoid erroneous change of proper selection of the number of turns based on the actual number of turns of the hook rope between the first number of turns and the second number of turns. In other words, even if the actual number of turns of the hook rope and the number of turns set in the overload prevention apparatus are different, the performance of the crane is determined according to the number of turns set in the overload prevention apparatus. Accordingly, the overload prevention apparatus is based on the premise that the setting of the number of turns is equal to the actual number of turns of the hook rope, and does not prevent erroneous setting of the number of turns.

CITATION LIST

Patent Literature

PTL 1

Japanese Patent Application Laid-Open No. 2007-204266

SUMMARY OF INVENTION

Technical Problem

An object of the present invention is to provide a crane that allows an operator to recognize errors in work information and the number of turns set in a safety apparatus.

Solution to Problem

A crane according to the present invention is a crane with wire ropes that are drawn in and out from a plurality of hydraulic winches and are suspended on a sheave of a boom to be derricked with a hydraulic cylinder or a sheave of a jib provided to a distal end section of the boom, the crane including: a safety apparatus that is configurable for both a hydraulic winch to be used among the plurality of hydraulic winches and the number of turns of the wire rope drawn in and out from the hydraulic winch to be used, in which tensions of the wire ropes are calculated from output torques of the plurality of hydraulic winches and winding radiuses of the wire ropes wound around the plurality of hydraulic winches, and when the tension of the wire rope wound around a hydraulic winch different from the hydraulic winch to be used set in the safety apparatus is greater than or equal to a reference value, it is determined that a setting in the safety apparatus is erroneous.

In the crane according to the present invention, an estimated suspension load is calculated from the number of turns of the wire rope drawn in and out from the hydraulic winch to be used set in the safety apparatus and the tension of the wire rope, an actual suspension load is calculated from a thrust of the hydraulic cylinder and a shape and attitude of the boom or shapes and attitudes of the boom and the jib, and when a difference between the estimated suspension load and actual suspension load is out of a predetermined range, preferably, it is determined that a setting in the safety apparatus is erroneous.

A crane according to the present invention is a crane with a wire rope that is drawn in and out from a hydraulic winch and is suspended on a sheave of a boom to be derricked with a hydraulic cylinder or a sheave of a jib provided to a distal end section of the boom, the crane including: a safety apparatus that is configurable for the number of turns of the wire rope drawn in and out from the hydraulic winch, in which a tension of the wire rope is calculated from an output torque of the hydraulic winch and a winding radius of the wire rope wound around the hydraulic winch, an estimated suspension load is calculated from the number of turns of the wire rope set in the safety apparatus and the tension of the wire rope, an actual suspension load is calculated from a thrust of the hydraulic cylinder and a shape and attitude of the boom or shapes and attitudes of the boom and the jib, and when a difference between the estimated suspension load and actual suspension load is out of a predetermined range, it is determined that a setting in the safety apparatus is erroneous.

In the crane according to the present invention, a torque of the hydraulic winch is calculated from a hydraulic pressure in a draw-in side part of the hydraulic winch and a hydraulic pressure in a draw-out side part of the hydraulic winch, and a thrust of the hydraulic cylinder, preferably, is calculated from a hydraulic pressure in a head side oil chamber of the hydraulic cylinder and a hydraulic pressure in the rod side oil chamber of the hydraulic cylinder.

In the crane according to the present invention, when it is determined that a setting in an apparatus selecting the winch to be used is erroneous, preferably, the safety apparatus informs of an error in the setting or a content of the error in the setting.

Advantageous Effects of Invention

In a crane of the present invention, the suitability of the work information set in the safety apparatus is quickly determined according to the operation of the crane by the operator. Thus, in the case where a plurality of winches is provided, the operator can recognize that the work information set in the safety apparatus is erroneous.

In a crane of the present invention, the suitability of an estimated suspension load reflecting a value set by the operator as a requirement, is determined with reference to the actual suspension load. Thus, an operator can recognize errors in work information and the number of turns set in a safety apparatus.

In a crane of the present invention, an estimated suspension load is calculated considering a friction between a wire rope and a plurality of sheaves or a friction against other movable sections and the efficiency of a hydraulic pressure system. Thus, based on the numeral values corresponding to safety aspects, an operator can recognize errors in work information and the number of turns set in a safety apparatus.

In a crane of the present invention, the crane can transmit an erroneous setting in the safety apparatus and the contents of the erroneous setting to the operator. Thus, the operator can recognize errors in work information and the number of turns set in a safety apparatus.

DESCRIPTION OF EMBODIMENTS

Crane 1 according to one embodiment of a crane will now be described with reference to FIGS. 1 to 4. Crane 1, which is described as a mobile crane in this embodiment, may be any crane that includes a boom designed to be derricked with a hydraulic cylinder, and a plurality of hydraulic winches.

Figure 1:
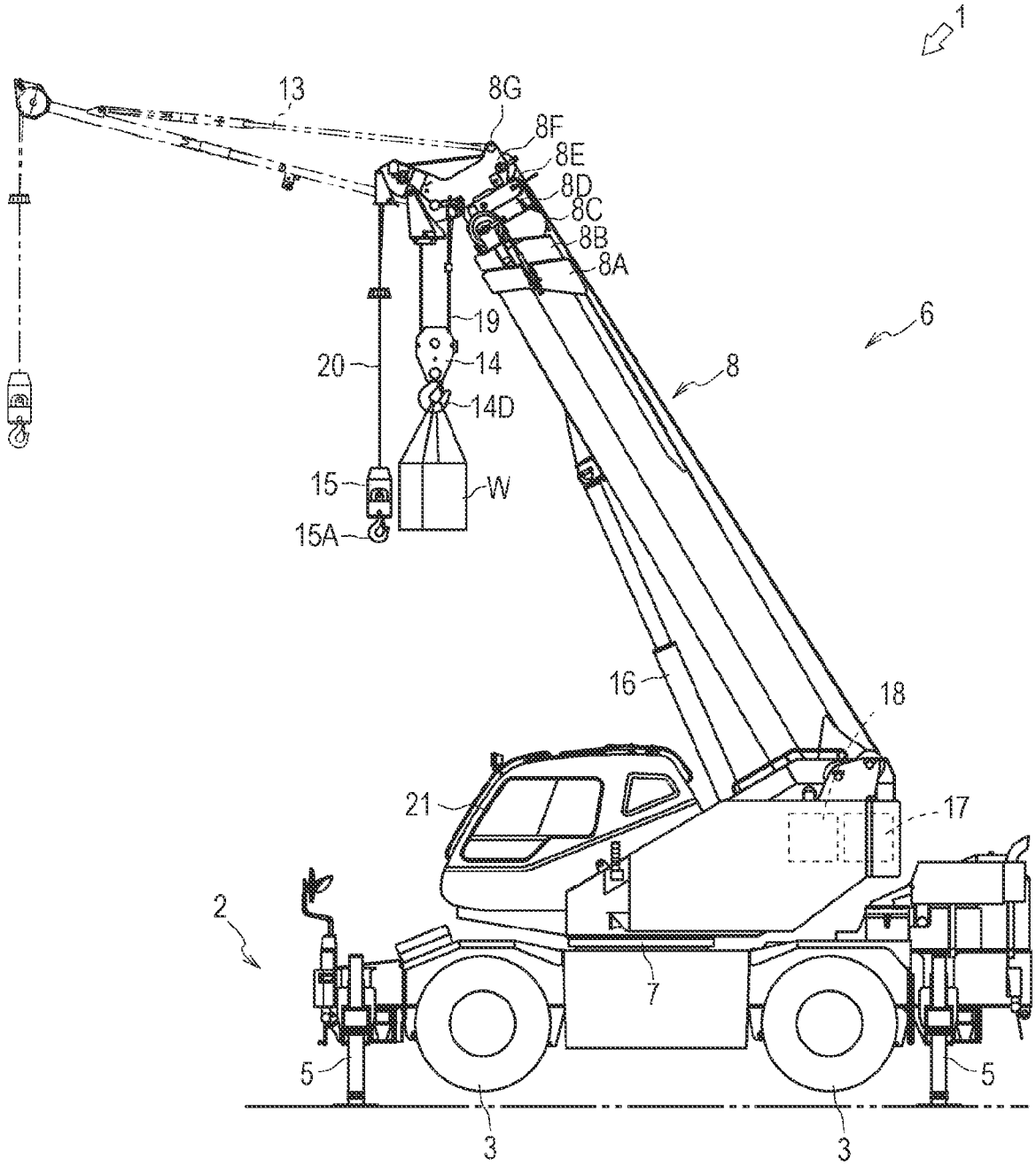
FIG. 1 is a side view showing the entire configuration of a crane according to one embodiment of the present invention.

As shown in FIG. 1, crane 1 is a mobile crane relocatable to an unspecified location. Crane 1 includes vehicle 2 and crane apparatus 6.

Vehicle 2 carries crane apparatus 6. Vehicle 2 has a plurality of wheels 3 and travels with engine 4 (see FIG. 6) which serves as a power source. Vehicle 2 is provided with outrigger 5. Outrigger 5 is made up of an overhang beam which can be extended by hydraulic pressure in the width direction of vehicle 2 toward both sides and hydraulic jack cylinders which can be extended in a direction perpendicular to the ground. In the vehicle, outrigger 5 can be extended in the width direction of the vehicle and the workable range of crane 1 can be extended by grounding the jack cylinders.

Crane apparatus 6 lifts object W, with a wire rope. Crane apparatus 6 includes swivel base 7, telescoping boom 8, jib 13, main hook block 14, sub-hook block 15, derricking cylinder 16, main winch 17, sub-winch 18, main wire rope 19, sub-wire rope 20, cabin 21, and safety apparatus 23 (see FIG. 3).

Swivel base 7 makes crane apparatus 6 rotatable. Swivel base 7 is provided on the frame of vehicle 2 through an annular bearing. The annular bearing is disposed such that its rotation axis can be perpendicular to the installation surface of vehicle 2. Swivel base 7 is configured to be rotatable about a rotation axis that passes the center of the annular bearing. Moreover, swivel base 7 is configured to be rotated through a hydraulic rotation motor which is not show n in the drawing. Swivel base 7 is provided with rotational position detection sensor 55 (see FIG. 9) for detecting the rotational position.

Telescoping boom 8 serving as a boom supports a wire rope so that object W can be lifted. Telescoping boom 8 is made up of a plurality of boom members: base boom member 8A, second boom member 8B, third boom member 8C, fourth boom member 8D, fifth boom member 8E, and top boom member 8F. The boom members are hollow cylinders with polygonal cross-sections similar to each other. The boom members have such sizes that they can be inserted in one another in descending order of cross sectional area. In other words, top boom member 8F with the smallest cross sectional area has such a size that it can be inserted in fifth boom member 8E with a cross sectional area following that of top boom member 8F. Fifth boom member 8E has such a size that it can be inserted in fourth boom member 8D with a cross sectional area following that of fifth boom member 8E. In this manner, in telescoping boom 8, second boom member 8B, third boom member 8C, fourth boom member 8D, fifth boom member 8E, and top boom member 8F are nested in base boom member 8A, which has the largest cross sectional area, in descending order of cross sectional area.

Moreover, in telescoping boom 8, second boom member 8B, third boom member 8C, fourth boom member 8D, fifth boom member 8E, and top boom member 8F are configured to be movable in the axial direction of telescoping boom 8 with respect to base boom member 8A. In other words, telescoping boom 8 is configured to be telescopic by moving each boom member, for example, with a telescoping cylinder not shown in the drawing. In telescoping boom 8, the base end of base boom member 8A is provided on swivel base 7 so that it is swingable. Thus, telescoping boom 8 is configured to be horizontally rotatable on the frame of vehicle 2. Further, telescoping boom 8 is configured to be swingable about the base end of base boom member 8A with respect to swivel base 7.

Figure 2:
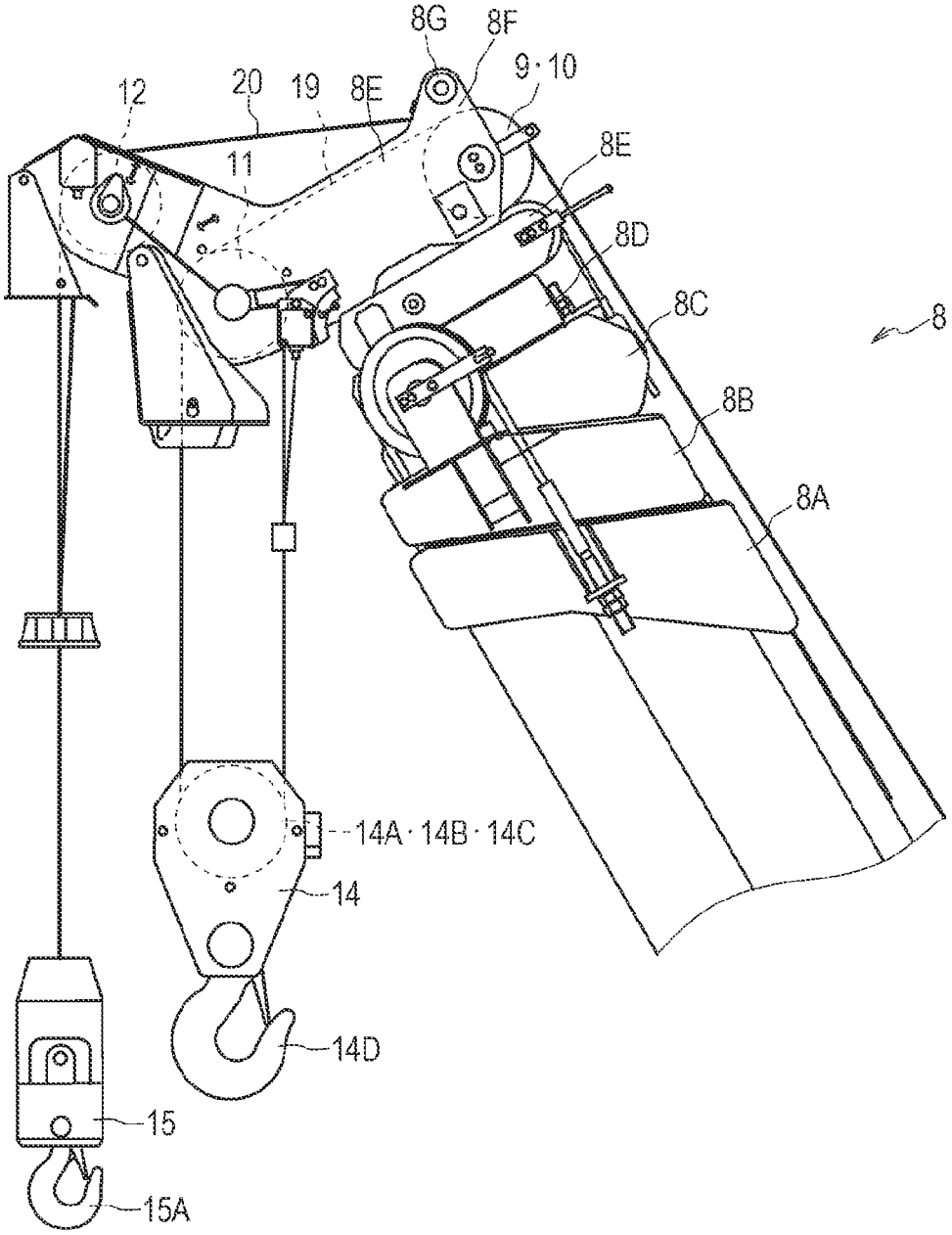
FIG. 2 is a side view showing a boom distal end section of the crane according to one embodiment of the present invention.

As shown in FIG. 2, the distal end of top boom member 8F of telescoping boom 8 is provided with main guide sheave 9, sub-guide sheave 10, main sheave 11, and sub-sheave 12. Main guide sheave 9 around which main wire rope 19 is wound and sub-guide sheave 10 around which sub-wire rope 20 is wound are rotatably provided to the back surface of the distal end of top boom member 8F (the side surface of standing telescoping boom 8 in the swinging direction). Sub-sheave 12 around which sub-wire rope 20 is wound and a plurality of main sheaves 11 around which main wire rope 19 is wound (first main sheave 11A, second main sheave 11B, and third main sheave 11C (see FIG. 5)) are rotatably provided, in this order from the distal end side, to the ventral surface of the distal end of top boom member 8F (the side surface of standing telescoping boom 8 in the direction opposite to the swinging direction). Moreover, jib support unit 8G is provided at the distal end of top boom member 8F. Telescoping boom 8 has boom length detection sensor 56 (see FIG. 9) for detecting boom length L (see FIGS. 10A and 10B) and derricking angle detection sensor 57 (see FIG. 9) for detecting derricking angle θ (see FIGS. 10A and 10B).

As shown in FIG. 1, jib 13 expands the lift and working radius of crane apparatus 6. Jib 13 is kept in posture along base boom member 8A by jib support unit 8G provided to base boom member 8A of telescoping boom 8. The base end of jib 13 is configured to be connectable to jib support unit 8G of top boom member 8F. Jib 13 is configured to be connectable to the distal end of top boom member 8F of telescoping boom 8 by hitting a pin (not shown in the drawing) to jib support unit 8G.

Object W is suspended on main hook block 14. Main hook block 14 has a plurality of hook sheaves around which main wire rope 19 is wound: first hook sheave 14A, second hook sheave 14B, and third hook sheave 14C (see FIGS. 2 and 5), and main hook 14D on which object W is suspended. Object W is suspended on sub-hook block 15. Sub-hook block 15 is provided with sub-hook 15A on which object W is suspended.

Derricking cylinder 16 makes telescoping boom 8 stand and lie down and holds the attitude of telescoping boom 8. Derricking cylinder 16 is composed of a hydraulic cylinder which is made up of a cylinder unit and a rod unit. In derricking cylinder 16, the direction of movement of the rod unit is changed by selective supply of hydraulic fluid to head side oil chamber 16A (see FIG. 8) and rod unit side oil chamber 16B (see FIG. 8). In derricking cylinder 16, an end of the cylinder unit is swingably coupled to swivel base 7, and an end of the rod unit is swingably coupled to base boom member 8A of telescoping boom 8. Thus, in derricking cylinder 16, hydraulic fluid is supplied in such a manner that the rod unit is pushed out from the cylinder unit so that base boom member 8A stands, and hydraulic fluid is supplied in such a manner that the rod unit is pushed back to the cylinder unit so that base boom member 8A lies down.

Main winch 17, which is a hydraulic winch, draws in (winds up) and draws out (winds down) main wire rope 19. Main winch 17 is configured such that main drum 17B (see FIG. 6) around which main wire rope 19 is wound can be rotated through main hydraulic motor 17A (see FIG. 6). Main winch 17 is provided to swivel base 7 so that the rotation shaft of main drum 17B can be orthogonal to the telescoping direction of telescoping boom 8. As for main hydraulic motor 17A, the rotation direction is changed between one direction and the other direction by selective supply of hydraulic fluid to a draw-in side plunger (hereinafter simply referred to as "draw-in side part") and a draw-out side plunger (hereinafter simply referred to as "draw-out side part"). Thus, in main winch 17, hydraulic fluid is supplied such that main hydraulic motor 17A can rotate in one direction and main wire rope 19 wound around main drum 17B can thus be drawn out, and hydraulic fluid is supplied such that main hydraulic motor 17A can rotate in the other direction and main wire rope 19 can thus be drawn in while being wound around main drum 17B.

Sub-winch 18, which is a hydraulic winch, draws in (winds up) and draws out (winds down) sub-wire rope 20. Sub-winch 18 is configured such that sub-drum 18B (see FIG. 7) around which sub-wire rope 20 is wound is rotated through sub-hydraulic motor 18A (see FIG. 7). Sub-winch 18 is provided to swivel base 7 so that the rotation shaft of sub-drum 18B can be orthogonal to the telescoping direction of telescoping boom 8. As for sub-hydraulic motor 18A of sub-winch 18, the rotation direction is changed between one direction and the other direction by selective supply of hydraulic fluid to the draw-in side part and the draw-out side part. Thus, in sub-winch 18, hydraulic fluid is supplied such that sub-hydraulic motor 18A can rotate in one direction and sub-wire rope 20 wound around sub-drum 18B can thus be drawn out, and hydraulic fluid is supplied such that sub-hydraulic motor 18A can rotate in the other direction and sub-wire rope 20 can thus be drawn in while being wound around sub-drum 18B.

Main wire rope 19 is passed from main winch 17 to a plurality of main sheaves 11 and first hook sheave 14A, second hook sheave 14B, or third hook sheave 14C through main guide sheave 9 and wound around them (see FIG. 2). An end of main wire rope 19 is fixed to top boom member 8F. Further, sub-wire rope 20 from sub-winch 18 is connected to sub-hook block 15 through sub-guide sheave 10 and sub-sheave 12.

Figure 3:
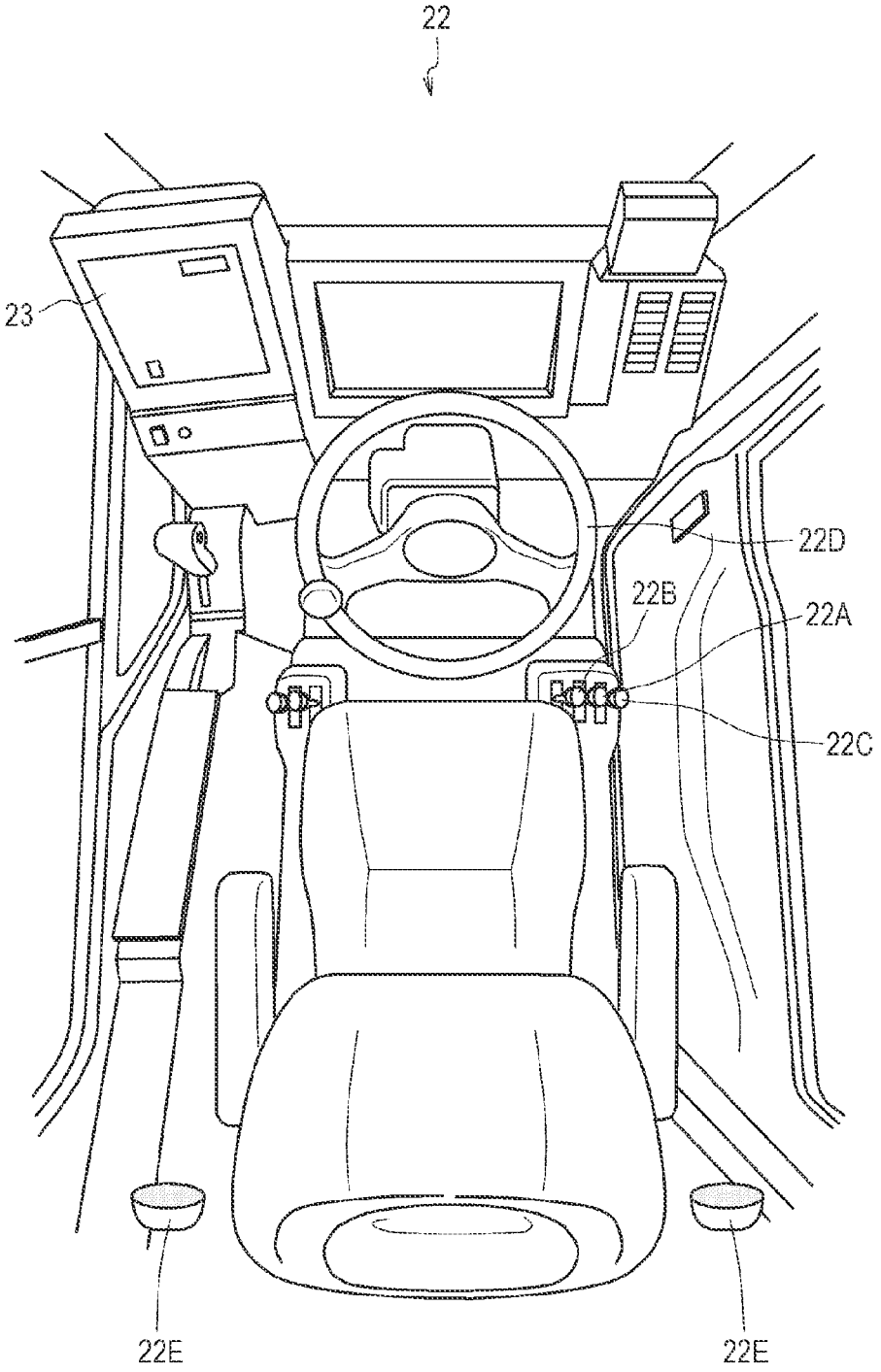
FIG. 3 is a diagram showing an operator's seat of the crane according to one embodiment of the present invention.

Cabin 21 covers operator's seat 22 (see FIG. 3). Cabin 21 is provided on a side of swivel base 7 adjacent to telescoping boom 8. Operator's seat 22 is provided in cabin 21.

As shown in FIG. 3, operator's seat 22 is provided with main operation tool 22A for operating main winch 17, sub-operation tool 22B for operating sub-winch 18, derricking operation tool 22C for operating telescoping boom 8, handle 22D for moving crane 1, alarm buzzer 22E serving as an informing section, and safety apparatus 23.

Figure 4A:
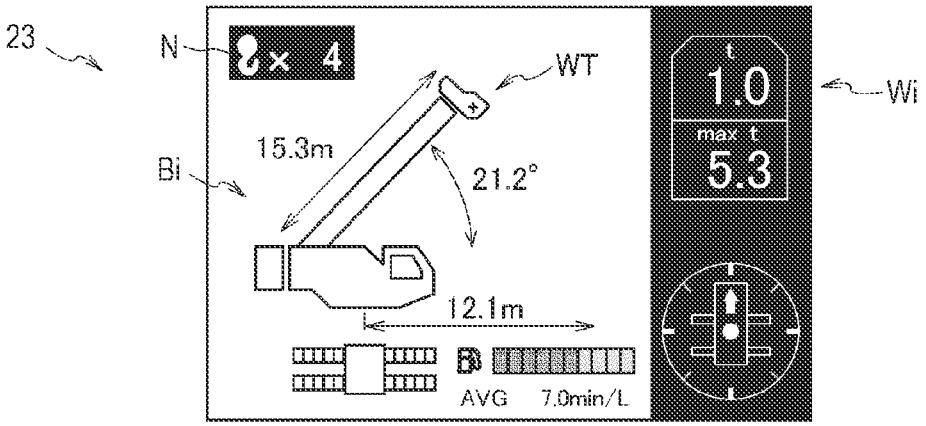
FIG. 4A shows a display screen of a safety apparatus of the crane according to one embodiment of the present invention, the screen showing the state of a boom.

As shown in FIG. 4A, safety apparatus 23 is used to set work type WT showing the mode of use of telescoping boom 8 and jib 13, and number of turns N. Safety apparatus 23 is made up of a display monitor such as a touch panel. Safety apparatus 23 allows various settings to be made from the display screen of the display monitor, displays load information Wi, rotational position, which is boom information Bi, boom length L of telescoping boom 8, and derricking angle θ of telescoping boom 8, and serves as an informing section that informs the operator of a warning or an alarm.

Figure 4B:
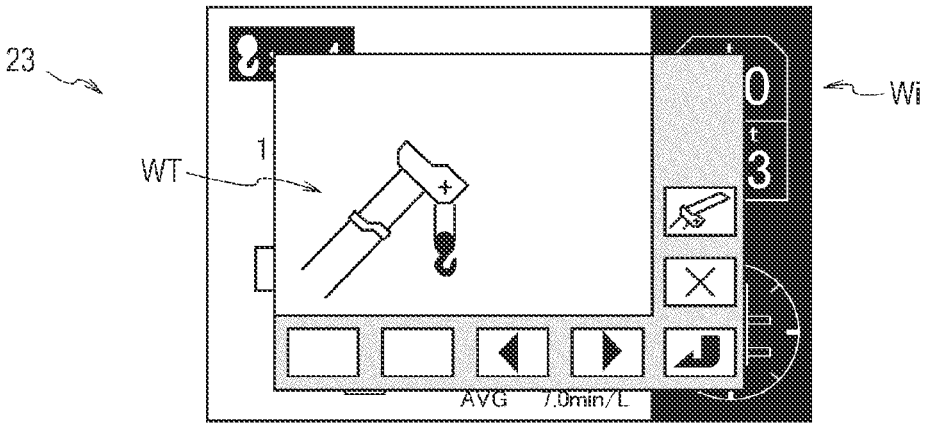
FIG. 4B shows a display screen of the same for setting a work type.

As shown in FIG. 4B, in safety apparatus 23, work type WT may be selectable from any one of a main hook work using main winch 17 in telescoping boom 8, a sub-hook work using sub-winch 18 in telescoping boom 8, and a jib work using sub-winch 18 by attaching jib 13 to telescoping boom 8. In other words, the safety apparatus is configured such that a winch to be used is selected between main winch 17 and sub-winch 18 according to work type WT.

Figure 4C:
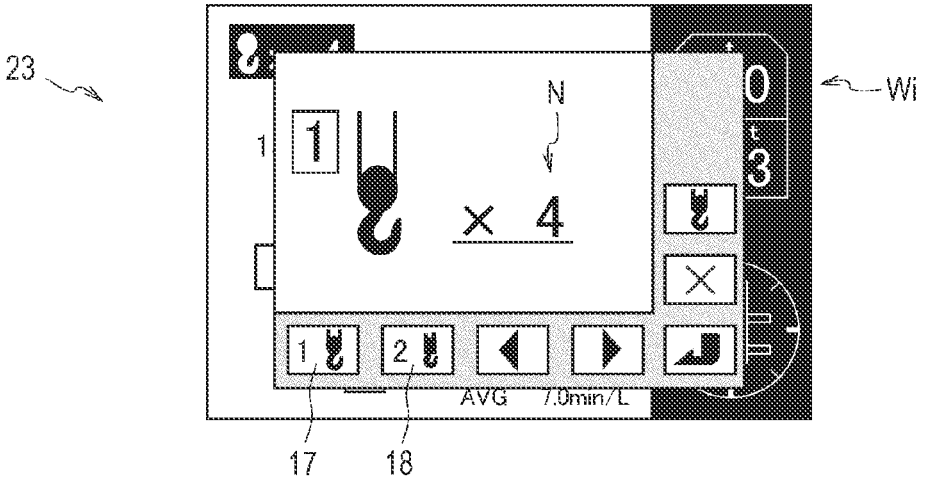
FIG. 4C shows a display screen of the same for setting the number of turns.

As shown in FIG. 4C, during the main hook work, safety apparatus 23 is configured to select number of turns N of main wire rope 19 to be drawn in and out from main winch 17, which is the winch Between four and six. Meanwhile, during the sub-hook work, safety apparatus 23 is configured to automatically select one as number of turns N of sub-wire rope 20 to be drawn in and out from sub-winch 18, which is the winch to be used. Further, safety apparatus 23 can display a warning or alarm related to the work area, suspended load, and the like on the screen, and inform the operator using alarm buzzer 22E (see FIG. 3) provided to operator's seat 22.

In crane 1 with such a configuration, crane apparatus 6 can be moved to an arbitrary position by running vehicle 2. Further, crane 1 can expand the lift and working radius of crane apparatus 6 by making telescoping boom 8 stand at arbitrary derricking angle θ through derricking cylinder 16, and extending telescoping boom 8 to arbitrary boom length L or connecting jib 13. Further, for crane 1, selection can be made between use of main winch 17 or use of sub-winch 18 according to the weight and the desired lifting rate of object W. Meanwhile, for crane 1, the allowable lifting load can be changed by changing number of turns N of main wire rope 19 according to the weight of object W. In crane 1, the work area and attitude of telescoping boom 8 is limited according to boom length L, derricking angle θ, and work type WT set through safety apparatus 23.

Winding of main wire rope 19 of crane 1 will now be described with reference to FIGS. 5A and 5B. Although the maximum number of turns N of main wire rope 19 of crane 1 is set to six in this embodiment, this is not necessarily the case as long as number of turns N of main wire rope 19 is changeable.

Figure 5A:
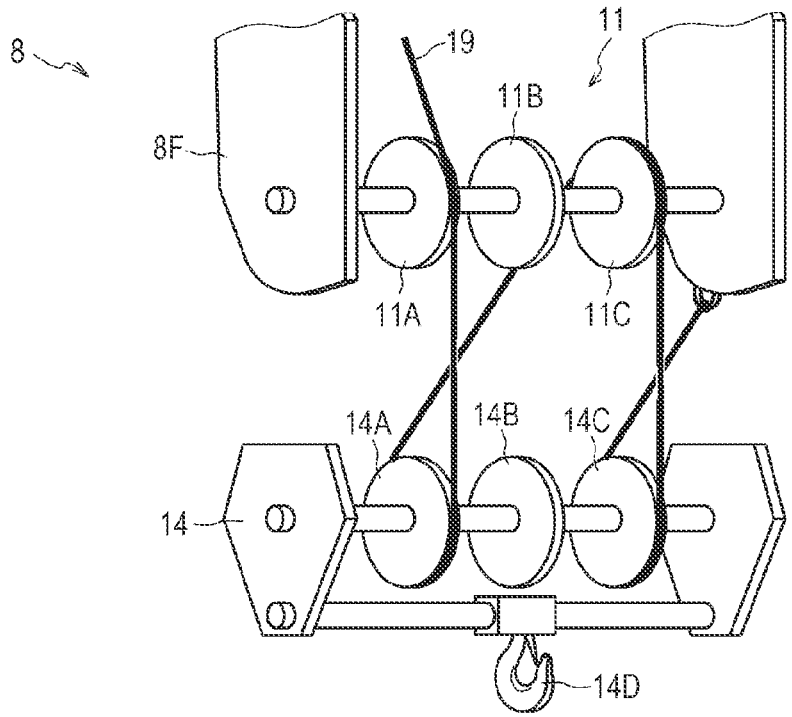
FIG. 5A is a diagram showing winding of a main wire rope in the case where the number of turns is four in the crane in one embodiment of the present invention.

As shown in FIG. 5A, at the distal end of top boom member 8F of telescoping boom 8, first main sheave 11A, second main sheave 11B, and third main sheave 11C which constitute main sheave 11, are arranged in this order from one side and independently rotatably supported by a support shaft disposed in parallel with the drum rotation shaft of main winch 17. First hook sheave 14A, second hook sheave 14B, and third hook sheave 14C are arranged in this order and independently rotatably supported in main hook block 14.

When number of turns N of main wire rope 19 is four, main wire rope 19 is wound around first main sheave 11A of top boom member 8F, first hook sheave 14A of main hook block 14, third main sheave 11C of top boom member 8F, and third hook sheave 14C of main hook block 14 in this order. Main wire rope 19 wound around third hook sheave 14C is coupled to top boom member 8F.

First hook sheave 14A of main hook block 14 is supported by main wire rope 19 wound around first main sheave 11A and main wire rope 19 wound around third main sheave 11C. Similarly third hook sheave 14C of main hook block 14 is supported by main wire rope 19 wound around third main sheave 11C and main wire rope 19 coupled to top boom member 8F.

With this configuration, crane 1 supports object W (see FIG. 1) suspended on main hook block 14 with a total of four main wire ropes 19 supporting first hook sheave 14A and third hook sheave 14C. Accordingly, the allowable load of crane 1 is increased to four times the allowable tension of main wire rope 19 by setting number of turns N of main wire rope 19 between main sheave 11 and the hook sheave to four. With four turns, crane 1 can lift object W, through the action of first hook sheave 14A and third hook sheave 14C, which are configured to serve as moving pulleys, with the tension of ¼ of the load on main hook 14D at a speed of ¼ of the draw-in speed of main wire rope 19.

Figure 5B:
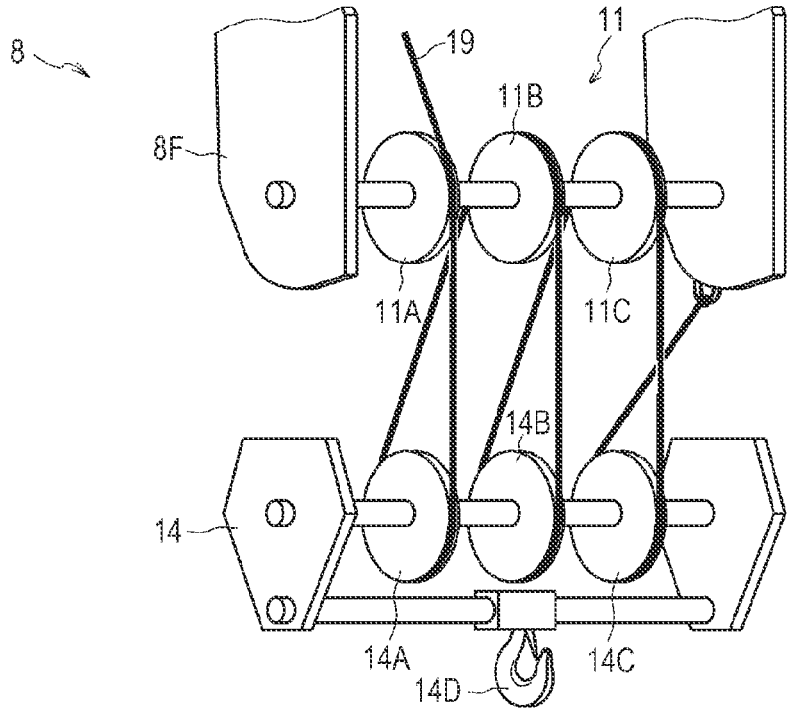
FIG. 5B is a diagram showing winding of a main wire rope in the case where the number of turns is six in the same crane.

As shown in FIG. 5B, when number of turns N of main wire rope 19 is six, main wire rope 19 is wound around first main sheave 11A of top boom member 8F, first hook sheave 14A of main hook block 14, second main sheave 11B of top boom member 8F, second hook sheave 14B of main hook block 14, third main sheave 11C of top boom member 8F, and third hook sheave 14C of main hook block 14 in this order. Main wire rope 19 wound around third hook sheave 14C is coupled to top boom member 8F.

First hook sheave 14A of main hook block 14 is supported by main wire rope 19 wound around first main sheave 11A and main wire rope 19 wound around third main sheave 11C. Similarly, second hook sheave 14B of main hook block 14 is supported by main wire rope 19 wound around second main sheave 11B and main wire rope 19 wound around third main sheave 11C. Similarly, third hook sheave 14C of main hook block 14 is supported by main wire rope 19 wound around third main sheave 11C and main wire rope 19 coupled to top boom member 8F.

With this configuration, crane 1 supports object W (see FIG. 1) suspended on main hook block 14 with a total of six main wire ropes 19 supporting first hook sheave 14A, second hook sheave 14B, and third hook sheave 14C. Accordingly, the allowable load of crane 1 is increased to six times the allowable tension of main wire rope 19 by setting number of turns N of main wire rope 19 between main sheave 11 and the hook sheave to six. With six turns, crane 1 can lift object W through the action of first hook sheave 14A, second hook sheave 14B, and third hook sheave 14C, which are configured to serve as moving pulleys, with the tension of ⅙ of the load on main hook 14D at a speed of ⅙ of the draw-in speed of main wire rope 19.

When number of turns N of main wire rope 19 is changed from six to four, in crane 1, main wire rope 19 and top boom member 8F are separated. In addition, in crane 1, number of turns N is changed such that main wire rope 19 is wound around first main sheave 11A, first hook sheave 14A, third main sheave 11C, and third hook sheave 14C in this order. Main wire rope 19 is coupled to top boom member 8F again, so that Crane 1 changes into the state where main hook block 14 is suspended by four main wire ropes through first hook sheave 14A and third hook sheave 14C.

As shown in FIG. 2, in use of sub-wire rope 20, sub-wire rope 20 drawn out from sub-winch 18 is wound around sub-sheave 12 of top boom member 8F through sub-guide sheave 10. A sub-hook block 15 is coupled to the distal end of sub-wire rope 20. With such a configuration, in crane 1, object W (see FIG. 1) suspended on sub-hook block 15 is supported with one sub-wire rope 20. Accordingly, the allowable load of crane 1 is equal to the allowable tension of sub-wire rope 20. In the case where object W is lifted with sub-wire rope 20, crane 1 can lift object W at a speed equal to the speed of drawing in sub-wire rope 20 with the tension equal to the load on sub-hook 15A. In other words, in the case where object W is lifted with sub-winch 18, in crane 1, the allowable load is ¼ of that obtained with main winch 17 with four turns while the lifting speed is four times that obtained with main winch 17 with four turns.

A hydraulic circuit related to derricking cylinder 16, main winch 17, and sub-winch 18 in crane 1 will be now described with reference to FIGS. 6 to 8.

Figure 6:
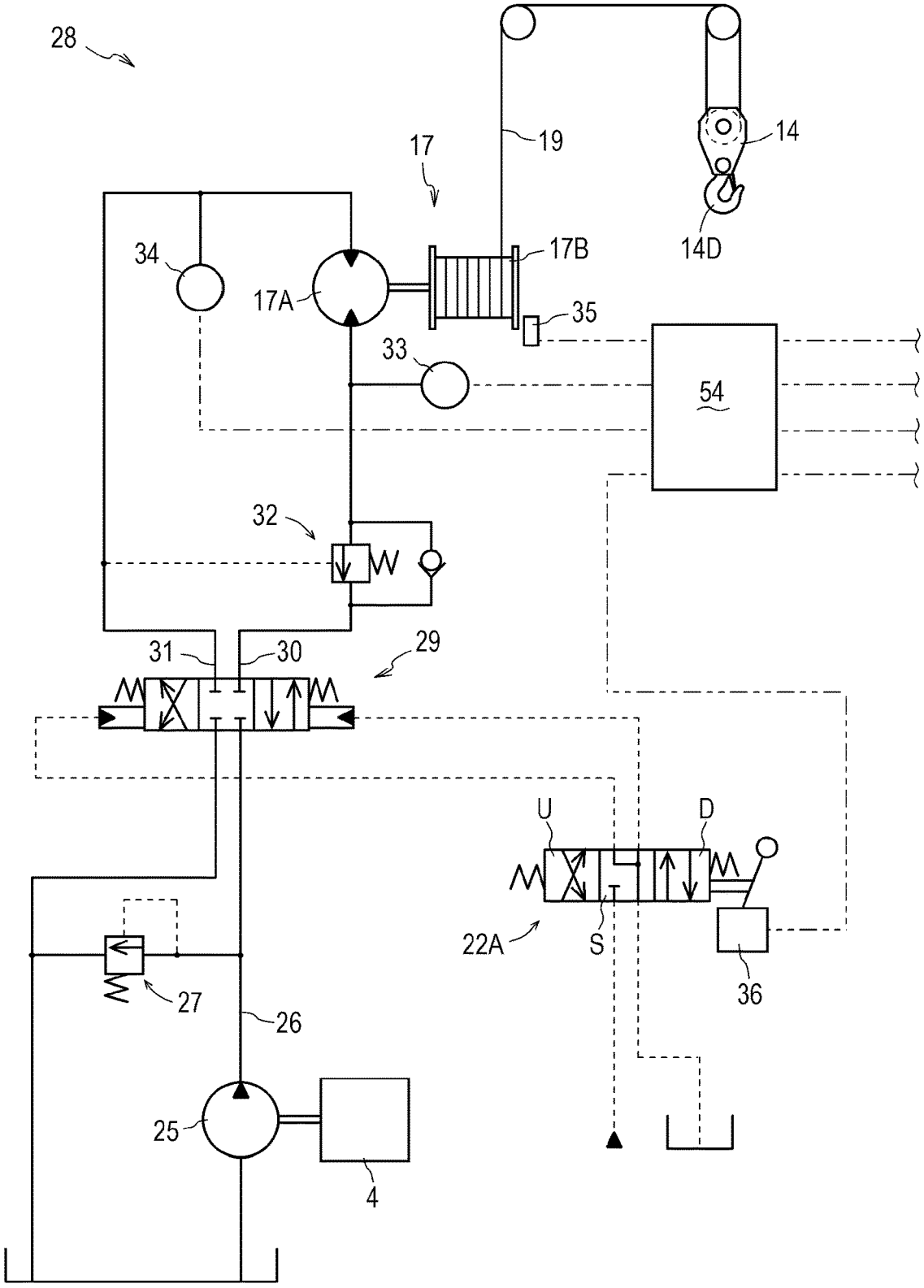
FIG. 6 is a diagram showing a hydraulic circuit for a main winch of the crane according to one embodiment of the present invention.
Figure 7:
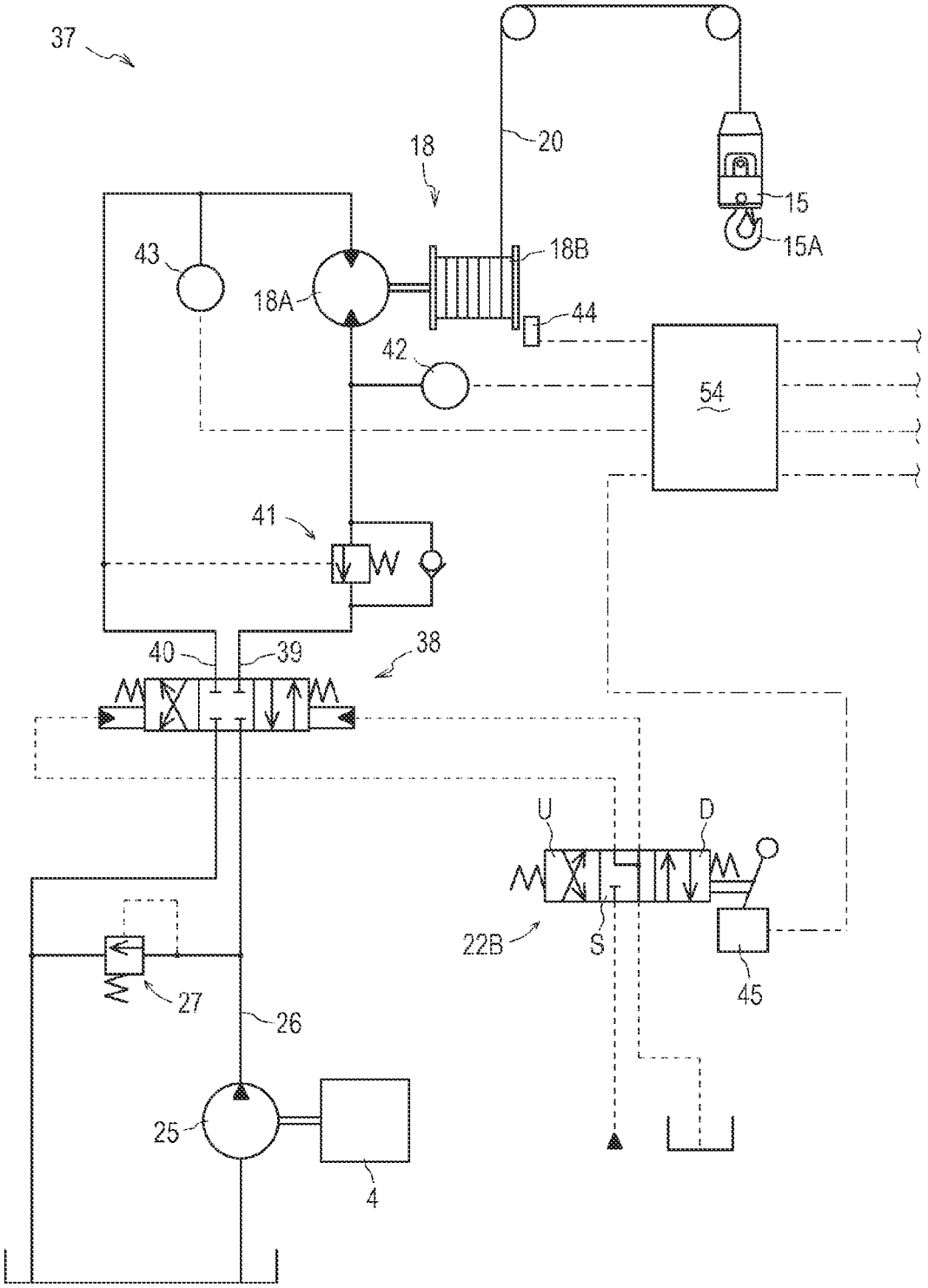
FIG. 7 is a diagram showing a hydraulic circuit for a sub-winch of the crane according to one embodiment of the present invention.
Figure 8:
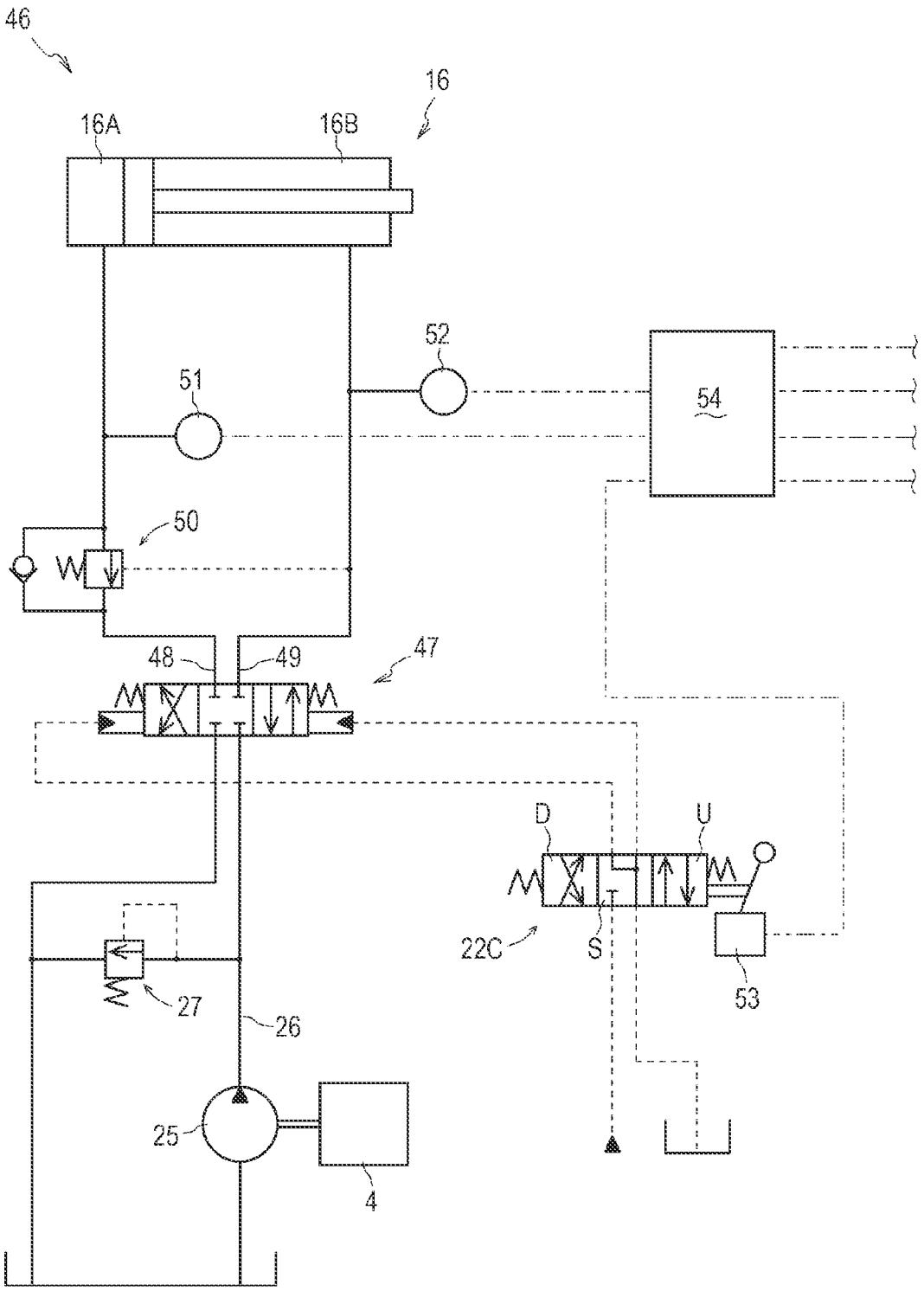
FIG. 8 is a diagram showing a hydraulic circuit for a derricking cylinder of the crane according to one embodiment of the present invention.

As shown in FIGS. 6 to 8, hydraulic circuit includes hydraulic pump 25 receiving driving force from engine 4, main hydraulic circuit 28 (see FIG. 6), sub-hydraulic circuit 37 (see FIG. 7), derricking hydraulic circuit 46 (see FIG. 8), and control apparatus 54.

Hydraulic pump 25 discharges hydraulic fluid. Hydraulic pump 25 is driven by engine 4. Hydraulic fluid discharged from hydraulic pump 25 is supplied to main hydraulic circuit 28, sub-hydraulic circuit 37, and derricking hydraulic circuit 46. Discharged oil passage 26 of hydraulic pump 25 is provided with relief valve 27.

As shown in FIG. 6, main hydraulic circuit 28 actuates main winch 17. Main hydraulic circuit 28 includes main hydraulic motor 17A, main pilot type switching valve 29, main counterbalance valve 32, main operation tool 22A, main one-side hydraulic pressure sensor 33, main other-side hydraulic pressure sensor 34, main drum rotation number detector 35, and main operational position detector 36.

Main hydraulic motor 17A rotates main drum 17B of main winch 17. Main hydraulic motor 17A is configured to cooperate with and connected to main drum 17B. When hydraulic fluid is supplied to the draw-in side part, main hydraulic motor 17A rotates main drum 17B in a direction in which main wire rope 19 is drawn in. When hydraulic fluid is supplied to the draw-out side part, main hydraulic motor 17A rotates main drum 17B in a direction in which main wire rope 19 is drawn out.

Main operation tool 22A controls the behavior of main winch 17. Main operation tool 22A is made up of a switching valve that allows the pilot pressure applied to main pilot type switching valve 29 to be switched by an external operation. Pilot hydraulic pressure is supplied from a pressure source to main operation tool 22A.

When the spool is located in neutral position S through operation, main operation tool 22A does not allow the pilot pressure from the pressure source to be applied to main pilot type switching valve 29. When the spool is located in draw-in position U through operation, main operation tool 22A allows the pilot pressure from the pressure source to be applied to main pilot type switching valve 29 so that one port of main pilot type switching valve 29 is opened. When the spool is located in draw-out position D through operation, main operation tool 22A allows the pilot pressure from the pressure source to be applied to main pilot type switching valve 29 so that the other port of main pilot type switching valve 29 is opened.

Main pilot type switching valve 29 switches the direction of hydraulic fluid supplied to main hydraulic motor 17A. The supply port of main pilot type switching valve 29 is connected to hydraulic pump 25 through discharged oil passage 26. One port of main pilot type switching valve 29 is connected to the draw-in side part of main hydraulic motor 17A through main one-side oil passage 30. The other port of main pilot type switching valve 29 is connected to the draw-out side part of main hydraulic motor 17A through main other-side oil passage 31.

In main pilot type switching valve 29, when the pilot pressure is not applied (when the spool of main operation tool 22A is located in neutral position S through operation), main one-side oil passage 30 and main other-side oil passage 31 are closed. This keeps the rotational position of main hydraulic motor 17A. In main pilot type switching valve 29, when the pilot pressure is applied such that one port can be opened (when the spool of main operation tool 22A is located in draw-in position U through operation), hydraulic fluid from hydraulic pump 25 is supplied to the draw-in side part (wind-up side part) of main hydraulic motor 17A through main one-side oil passage 30. Thus, main hydraulic motor 17A is rotated in a direction in which main wire rope 19 is drawn in. In main pilot type switching valve 29, when the pilot pressure is applied such that the other port can be opened (when the spool of main operation tool 22A is located in draw-out position D through operation), hydraulic fluid from hydraulic pump 25 is supplied to the draw-out side (wind-down side part) of main hydraulic motor 17A through main other-side oil passage 31. Thus, main hydraulic motor 17A is rotated in a direction in which main wire rope 19 is drawn out.

Main counterbalance valve 32 prevents main hydraulic motor 17A from being rotated by the load on main wire rope 19. Main counterbalance valve 32 is provided to main one-side oil passage 30. Further, main counterbalance valve 32 is configured to receive the hydraulic pressure in main other-side oil passage 31 serving as pilot pressure. Main counterbalance valve 32 always permits hydraulic fluid to flow into the draw-in side part (wind-up side part) of main hydraulic motor 17A. On the other hand, main counterbalance valve 32 permits the flow of hydraulic fluid discharged from the draw-in side part of main hydraulic motor 17A only when hydraulic fluid is supplied to the draw-out side part of main hydraulic motor 17A.

Main one-side hydraulic pressure sensor 33 and main other-side hydraulic pressure sensor 34 detect values of hydraulic pressure. Main one-side hydraulic pressure sensor 33 is provided to main one-side oil passage 30. In other words, main one-side hydraulic pressure sensor 33 is configured to detect the value of hydraulic pressure supplied to the draw-in side part (wind-up side part) of main hydraulic motor 17A. Main other-side hydraulic pressure sensor 34 is provided to main other-side oil passage 31. In other words, main other-side hydraulic pressure sensor 34 is configured to detect the value of hydraulic pressure supplied to the draw-out side part (wind-down side part) of main hydraulic motor 17A.

Main drum rotation number detector 35 detects the number of rotations from the reference position of main drum 17B. Main drum rotation number detector 35 detects the number of rotations needed for winding in main wire rope 19 of main drum 17B, considering the state where main wire rope 19 is all drawn out from main drum 17B as a reference. In other words, main drum rotation number detector 35 is configured to detect the number of layers of main wire rope 19 wound in layers around main drum 17B.

Main operational position detector 36 detects the operational position of main operation tool 22A. Main operational position detector 36 is configured to detect the operational position in which the spool of main operation tool 22A is in neutral position S, the operational position in which the spool is in draw-in position U, and the operational position in which the spool is in draw-out position D.

Crane 1 including main hydraulic circuit 28 with such a configuration operates main pilot type switching valve 29 through main operation tool 22A, thereby switching the flow of hydraulic fluid supplied to main hydraulic motor 17A. Thus, for crane 1, main wire rope 19 can be freely drawn in and out with main winch 17 through the operation of main operation tool 22A.

As shown in FIG. 7, sub-hydraulic circuit 37 actuates sub-winch 18. Sub-hydraulic circuit 37 includes sub-hydraulic motor 18A, sub-pilot type switching valve 38, sub-counterbalance valve 41, sub-operation tool 22B, sub-one-side hydraulic pressure sensor 42, sub-other-side hydraulic pressure sensor 43, sub-drum rotation number detector 44, and sub-operational position detector 45. It should be noted that the configuration and behavior of sub-hydraulic circuit 37 is the same as those of main hydraulic circuit 28 and the description of their details will therefore be omitted.

Crane 1 including sub-hydraulic circuit 37 with such a configuration operates sub-pilot type switching valve 38 through sub-operation tool 22B, thereby switching the flow of hydraulic fluid supplied to sub-hydraulic motor 18A. Thus, for crane 1, sub-wire rope 20 can be freely drawn in and out with sub-winch 18 through the operation of sub-operation tool 22B.

As shown in FIG. 8, derricking hydraulic circuit 46 actuates derricking cylinder 16. Derricking hydraulic circuit 46 includes derricking cylinder 16, derricking pilot type switching valve 47, derricking counter balance valve 50, derricking operation tool 22C, derricking one-side hydraulic pressure sensor 51, derricking other-side hydraulic pressure sensor 52, and derricking operational position detector 53.

Derricking operation tool 22C controls the behavior of derricking cylinder 16. Derricking operation tool 22C is made up of a switching valve that allows the pilot pressure applied to derricking pilot type switching valve 47 to be switched by an external operation. Pilot hydraulic pressure is supplied from a pressure source to derricking operation tool 22C.

When the spool is located in neutral position S through operation, derricking operation tool 22C does not allow the pilot pressure from the pressure source to be applied to derricking pilot type switching valve 47. When the spool is located in standing position U through operation, derricking operation tool 22C allows the pilot pressure from the pressure source to be applied to derricking pilot type switching valve 47 so that one port of derricking pilot type switching valve 47 is opened. When the spool is located in lying position D through operation, derricking operation tool 22C allows the pilot pressure from the pressure source to be applied to derricking pilot type switching valve 47 so that the other port of derricking pilot type switching valve 47 is opened.

Derricking pilot type switching valve 47 switches the direction of hydraulic fluid supplied to derricking cylinder 16. The supply port of derricking pilot type switching valve 47 is connected to hydraulic pump 25 through discharged oil passage 26. One port of derricking pilot type switching valve 47 is connected to head side oil chamber 16A of derricking cylinder 16 through derricking one-side oil passage 48. The other port of derricking pilot type switching valve 47 is connected to rod unit side oil chamber 16B of derricking cylinder 16 through derricking other-side oil passage 49.

In derricking pilot type switching valve 47, when the pilot pressure is not applied (when the spool of derricking operation tool 22C is located in neutral position S through operation), derricking one-side oil passage 48 and derricking other-side oil passage 49 are closed. This keeps the rod unit position of derricking cylinder 16. In derricking pilot type switching valve 47, when the pilot pressure is applied such that one port can be opened (when the spool of derricking operation tool 22C is located in standing position U through operation), hydraulic fluid from hydraulic pump 25 is supplied to head side oil chamber 16A of derricking cylinder 16 through derricking one-side oil passage 48. Thus, in derricking cylinder 16, the rod unit is pushed out from the cylinder unit so that telescoping boom 8 can stand. In derricking pilot type switching valve 47, when the pilot pressure is applied such that the other port can be opened (when the spool of derricking operation tool 22C is located in lying position D through operation), hydraulic fluid from hydraulic pump 25 is supplied to rod unit side oil chamber 16B of derricking cylinder 16 through derricking other-side oil passage 49. Thus, in derricking cylinder 16, the rod unit is pushed back to the cylinder unit so that telescoping boom 8 can lie down.

Derricking counter balance valve 50 prevents the rod unit of derricking cylinder 16 from being pushed back by the load on telescoping boom 8. Derricking counter balance valve 50 is provided to derricking one-side oil passage 48. Further, derricking counter balance valve 50 is configured to receive the hydraulic pressure in derricking other-side oil passage 49 serving as pilot pressure. Derricking counter balance valve 50 always permits hydraulic fluid to flow into head side oil chamber 16A of derricking cylinder 16. On the other hand, derricking counter balance valve 50 permits the flow of hydraulic fluid to be discharged from head side oil chamber 16A of derricking cylinder 16 only when rod unit side oil chamber 16B of derricking cylinder 16 is supplied with hydraulic fluid.

Derricking one-side hydraulic pressure sensor 51 and derricking other-side hydraulic pressure sensor 52 detect values of hydraulic pressure. Derricking one-side hydraulic pressure sensor 51 is provided to derricking one-side oil passage 48. In other words, derricking one-side hydraulic pressure sensor 51 is configured to detect the value of hydraulic pressure supplied to head side oil chamber 16A of the derricking cylinder. Derricking other-side hydraulic pressure sensor 52 is provided to derricking other-side oil passage 49. In other words, derricking other-side hydraulic pressure sensor 52 is configured to detect the value of hydraulic pressure supplied to rod unit side oil chamber 16B of the derricking cylinder.

Derricking operational position detector 53 detects the operational position of derricking operation tool 22C. Derricking operational position detector 53 detects the operational position in which the spool of derricking operation tool 22C is in neutral position S, the operational position in which the spool is in standing position U, and the operational position in which the spool is in lying position D.

Crane 1 including derricking hydraulic circuit 46 with such a configuration operates derricking pilot type switching valve 47 through derricking operation tool 22C, thereby changing the flow of hydraulic fluid supplied to derricking cylinder 16. Thus, for crane 1, telescoping boom 8 can be freely made stand and lie down with derricking cylinder 16 by the operation of derricking operation tool 22C.

The configuration of control apparatus 54 of crane 1 with the above-described configuration, determination of an erroneous setting related to safety apparatus 23 through control apparatus 54 will now be described with reference to FIGS. 9 to 13.

Figure 9:
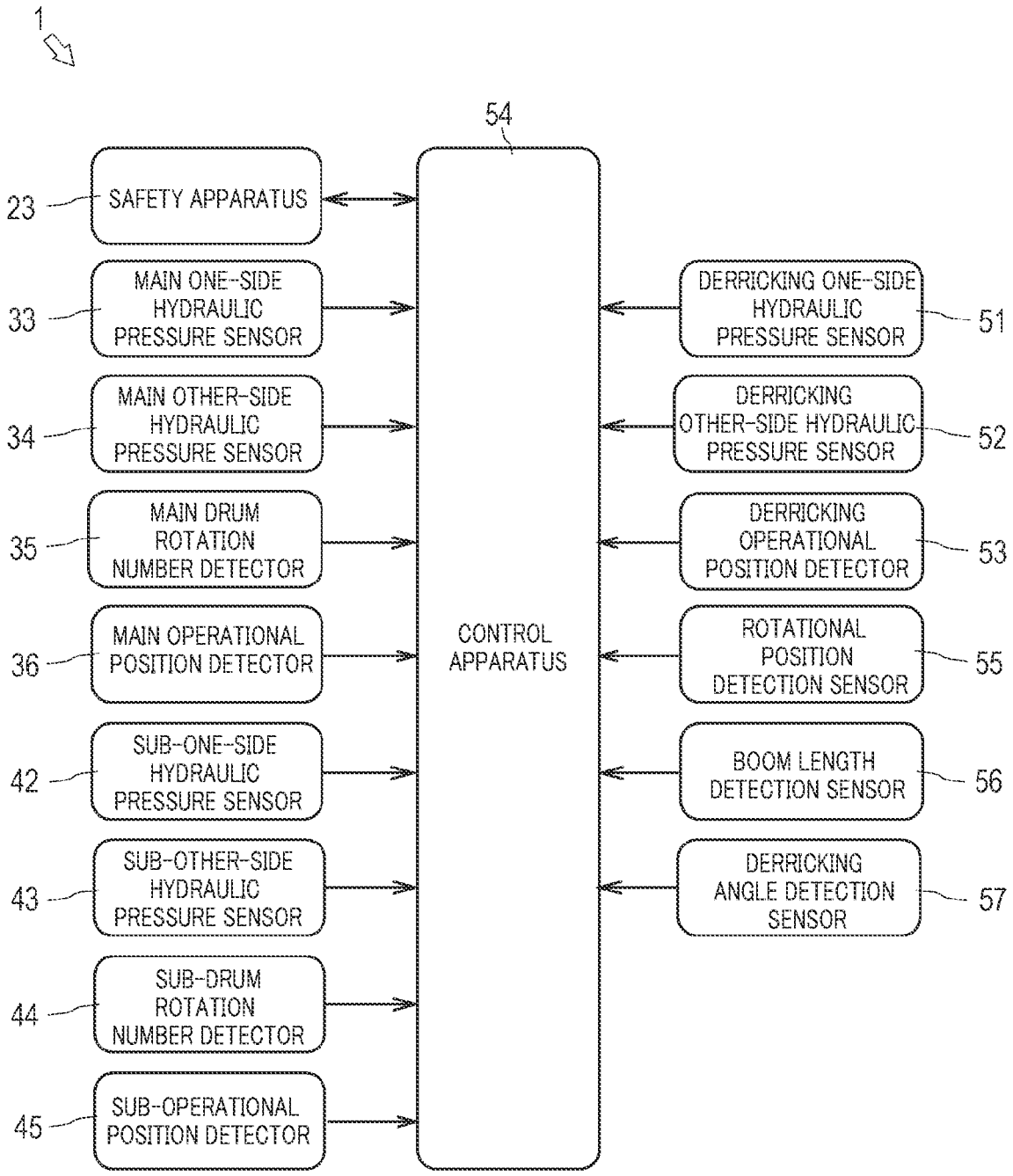
FIG. 9 is a diagram showing a configuration of a control apparatus of the crane according to one embodiment of the present invention.

As shown in FIG. 9, control apparatus 54 limits the work area of telescoping boom 8 and calculates main tension TSm which is the tension of main wire rope 19, sub-tension TSs which is the tension of sub-wire rope 20, estimated suspension load Le, and actual suspension load Lr. Substantively, control apparatus 54 may have a configuration in which a CPU, a ROM, a RAM, and an HDD, for example, are connected through a bus, or may be made up of a one-chip LSI, or the like. Control apparatus 54 stores various programs and data for calculating the work area of telescoping boom 8, main tension TSm, sub-tension TSs. and the weight of object W.

Control apparatus 54 is connected to safety apparatus 23 and can obtain information such as work type WT and number of turns N input from safety apparatus 23 and allows safety apparatus 23 to display various information, an alarm, and the like on the screen.

Control apparatus 54 is connected to main one-side hydraulic pressure sensor 33 and main other-side hydraulic pressure sensor 34. Control apparatus 54 obtains the value of the hydraulic pressure in the draw-in side part of main hydraulic motor 17A from main one-side hydraulic pressure sensor 33. Control apparatus 54 obtains the value of the hydraulic pressure in the draw-out side part of main hydraulic motor 17A from main other-side hydraulic pressure sensor 34.

Control apparatus 54 is connected to main drum rotation number detector 35. Control apparatus 54 obtains the number of rotations of main drum 17B from main drum rotation number detector 35. Control apparatus 54 determines the number of layers of main wire rope 19 wound around main drum 17B.

Control apparatus 54 is connected to main operational position detector 36. Control apparatus 54 obtains the operational position of main operation tool 22A from main operational position detector 36.

Control apparatus 54 is connected to sub-one-side hydraulic pressure sensor 42 and sub-other-side hydraulic pressure sensor 43. Control apparatus 54 obtains the value of the hydraulic pressure in the draw-in side part of sub-hydraulic motor 18A from sub-one-side hydraulic pressure sensor 42. Control apparatus 54 obtains the value of the hydraulic pressure in the draw-out side part of sub-hydraulic motor 18A from sub-other-side hydraulic pressure sensor 43.

Control apparatus 54 is connected to sub-drum rotation number detector 44. Control apparatus 54 obtains the number of rotations of sub-drum 18B from sub-drum rotation number detector 44. Control apparatus 54 determines the number of layers of sub-wire rope 20 wound around sub-drum 18B.

Control apparatus 54 is connected to sub-operational position detector 45. Control apparatus 54 obtains the operational position of sub-operation tool 22B from sub-operational position detector 45.

Control apparatus 54 is connected to derricking one-side hydraulic pressure sensor 51 and derricking other-side hydraulic pressure sensor 52. Control apparatus 54 obtains the value of the hydraulic pressure in head side oil chamber 16A of derricking cylinder 16 from derricking one-side hydraulic pressure sensor 51. Control apparatus 54 obtains the value of the hydraulic pressure in rod unit side oil chamber 16B of derricking cylinder 16 from derricking other-side hydraulic pressure sensor 52.

Control apparatus 54 is connected to derricking operational position detector 53. Control apparatus 54 obtains the operational position of derricking operation tool 22C from derricking operational position detector 53.

Control apparatus 54 is connected to rotational position detection sensor 55, boom length detection sensor 56, and derricking angle detection sensor 57. Control apparatus 54 obtains a rotational position, which is boom information Bi, from rotational position detection sensor 55. Control apparatus 54 obtains boom length L (see FIG. 10B), which is boom information Bi, from boom length detection sensor 56. Control apparatus 54 obtains derricking angle θ (see FIG. 10B), which is boom information Bi, from derricking angle detection sensor 57.

Next, a method of calculating estimated suspension load Le and actual suspension load Lr related to object W will be described with reference to FIGS. 10A and 10B. Estimated suspension load Le is the weight of object W calculated from main tension TSm and number of turns N or sub-tension TSs. Actual suspension load Lr is the weight of object W calculated from derricking thrust TH and boom information Bi related to telescoping boom 8. Note that in this embodiment, the calculation of estimated suspension load Le and actual suspension load Lr is related to the case where object W is suspended by only telescoping boom 8.

Figure 10A:
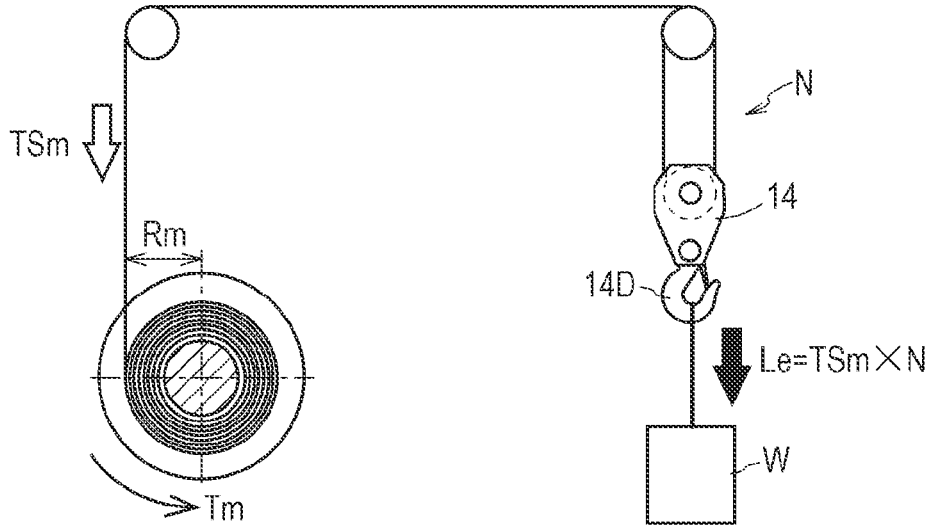
FIG. 10A is a diagram showing a method of calculating an estimated suspension load from a main tension and the number of turns in the crane according to one embodiment of the present invention.

As shown in FIG. 10A, in calculation of estimated suspension load Le on main wire rope 19, control apparatus 54 calculates main output torque Tm (see the arrow) of main hydraulic motor 17A, based on the value of the hydraulic pressure in the draw-in side part of main hydraulic motor 17A obtained from main one-side hydraulic pressure sensor 33, and the value of the hydraulic pressure in the draw-out side part of main hydraulic motor 17A obtained from main other-side hydraulic pressure sensor 34. In addition, control apparatus 54 calculates main drum winding radius Rm from the rotation axis of main drum 17B to the perimeter of main wire rope 19 wound around main drum 17B, based on the determined number of layers of main wire rope 19 wound around main drum 17B.

Control apparatus 54 calculates main tension TSm (see the white arrow) from the calculated main output torque Tm and main drum winding radius Rm. Further, control apparatus 54 calculates estimated suspension load Le (see the black arrow) of main wire rope 19 from the calculated main tension TSm and number of turns N of main wire rope 19 obtained from safety apparatus 23. Although main output torque Tm of main hydraulic motor 17A is calculated based on the hydraulic pressure obtained from main one-side hydraulic pressure sensor 33 and the hydraulic pressure obtained from main other-side hydraulic pressure sensor 34 in this embodiment, this is not necessarily the case and it may be calculated based on the operation state of main operation tool 22A obtained from main operational position detector 36 and the hydraulic pressure obtained from main one-side hydraulic pressure sensor 33. In this case, there is no need to install main other-side hydraulic pressure sensor 34.

Similarly, in calculation of estimated suspension load Le on sub-wire rope 20, control apparatus 54 calculates sub-output torque Ts of sub-hydraulic motor 18A from the value of the hydraulic pressure in the draw-in side part of sub-hydraulic motor 18A obtained from sub-one-side hydraulic pressure sensor 42, and the value of the hydraulic pressure in the draw-out side part of sub-hydraulic motor 18A obtained from sub-other-side hydraulic pressure sensor 43. In addition, control apparatus 54 calculates sub-drum winding radius Rs, based on the determined number of layers of sub-wire rope 20 wound around sub-drum 18B.

Control apparatus 54 calculates sub-tension TSs, which is estimated suspension load Le, from the calculated sub-output torque Ts and sub-drum winding radius Rm.

Figure 10B:
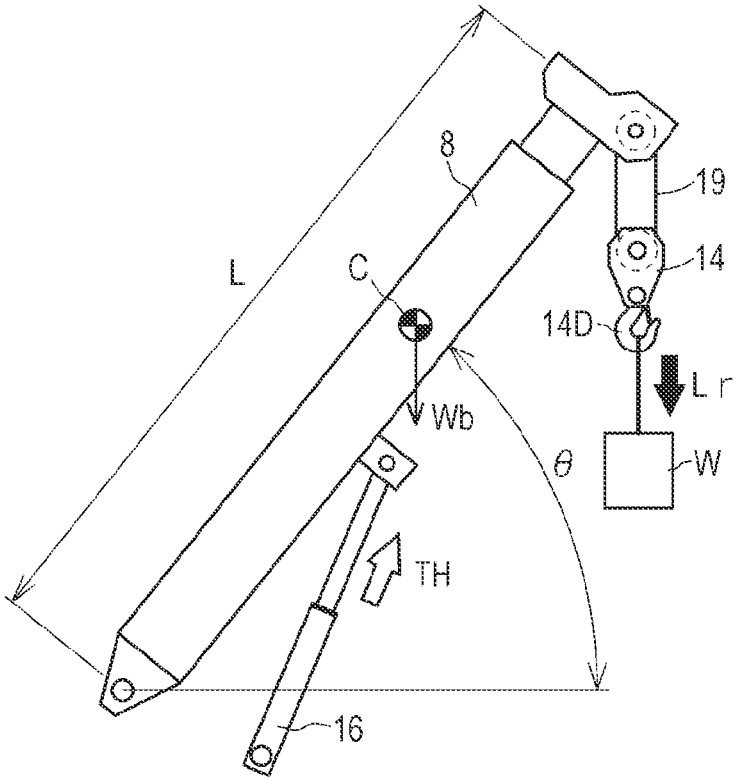
FIG. 10B is a diagram showing a method of calculating an actual suspension load from a derricking thrust and the state of the boom in the same crane.

As shown in FIG. 10B, in calculation of actual suspension load Lr on main wire rope 19 or sub-wire rope 20, control apparatus 54 calculates derricking thrust TH (see the white arrow), based on the value of the hydraulic pressure in head side oil chamber 16A of derricking cylinder 16 obtained from derricking one-side hydraulic pressure sensor 51, and the value of the hydraulic pressure in rod unit side oil chamber 16B of derricking cylinder 16 obtained from derricking other-side hydraulic pressure sensor 52.

Control apparatus 54 calculates actual suspension load Lr (see the black arrow), based on the calculated derricking thrust TH and boom information Bi consisting of position of center of gravity C of telescoping boom 8 representing the shape and attitude of telescoping boom 8, weight Wb of telescoping boom 8, boom length L of telescoping boom 8, and derricking angle θ of telescoping boom 8.

With such a configuration, in crane 1, estimated suspension load Le can be calculated from main tension TSm of main wire rope 19 or sub-tension TSs of sub-wire rope 20 calculated based on the detected values and work type WT and number of turns N input to safety apparatus 23. Further, in crane 1, actual suspension load Lr can be calculated based on derricking thrust TH and boom information Bi calculated based on the detected values.

Determination of an erroneous setting related to safety apparatus 23 of crane 1 with the above-described configuration will now be described. In this embodiment, it is assumed that control apparatus 54 of crane 1 obtains work type WT and number of turns N of main wire rope 19 from safety apparatus 23.

Control apparatus 54 of crane 1 obtains the value of the hydraulic pressure in the draw-in side part and the value of the hydraulic pressure in the draw-out side part of main hydraulic motor 17A at predetermined time intervals and calculates main output torque Tm of main hydraulic motor 17A. Further, control apparatus 54 calculates main tension TSm based on main output torque Tm and main drum winding radius Rm. Similarly, control apparatus 54 calculates sub-tension TSs based on sub-output torque Ts and sub-drum winding radius Rs at predetermined time intervals. Further, control apparatus 54 calculates estimated suspension load Le based on main tension TSm and number of turns N.

Further, control apparatus 54 obtains the value of the hydraulic pressure in head side oil chamber 16A and the value of the hydraulic pressure in rod unit side oil chamber 16B of derricking cylinder 16 at predetermined time intervals to calculate derricking thrust TH. Further, control apparatus 54 calculates actual suspension load Lr based on derricking thrust TH and boom information Bi.

Control apparatus 54 determines whether or not the winch (hereinafter simply referred to as "winch A") for the wire rope in which a tension (main tension TSm or sub-tension TSs calculated at predetermined time intervals) greater than or equal to reference value TSr is generated matches the winch (hereinafter simply referred to as "winch B") determined based on work type WT obtained from safety apparatus 23. When winch A and winch B do not match, control apparatus 54 displays the warning that the setting of work type WT is erroneous, on the display screen of safety apparatus 23. When winch A and winch B match, control apparatus 54 determines whether or not a difference between the calculated estimated suspension load Le and actual suspension load Lr is within predetermined range Ll. When the difference between the calculated estimated suspension load Le and actual suspension load Lr is out of predetermined range Ll, control apparatus 54 displays the warning that the setting of number of turns N is erroneous, on the display screen of safety apparatus 23.

Next, with reference to FIGS. 11 to 13, the manner of control of determination of erroneous settings related to safety apparatus 23 will be described in detail. In this embodiment, control apparatus 54 of crane 1 obtains boom information Bi. Control apparatus 54 obtains, at predetermined time intervals, main output torque Tm of main winch 17, sub-output torque Ts of sub-winch 18, and information needed to calculate derricking thrust TH.

Figure 11:
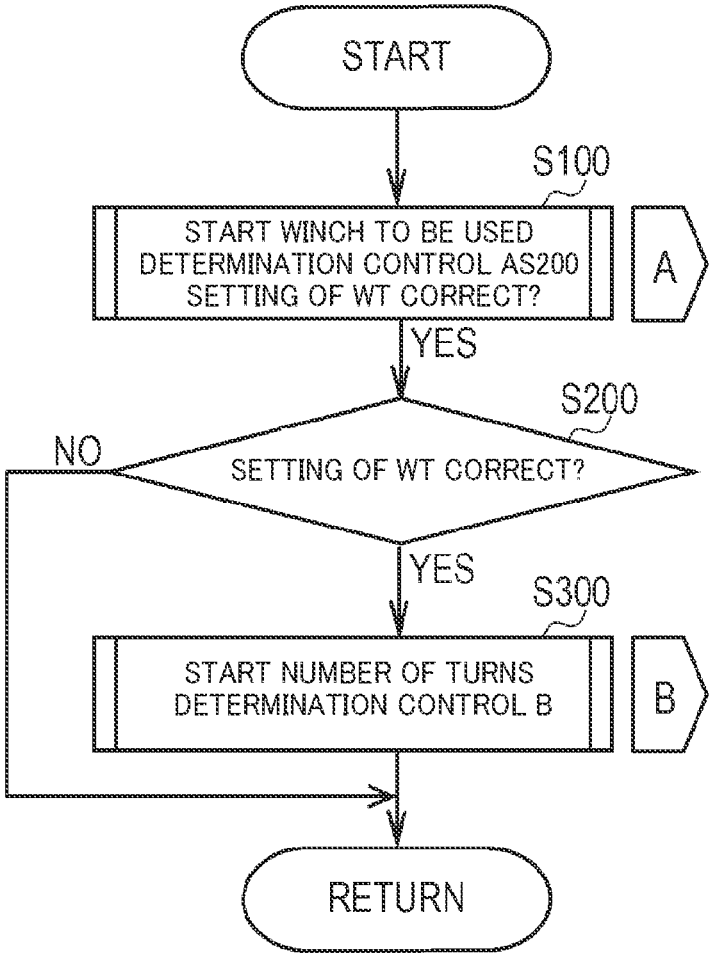
FIG. 11 is a flow chart showing control modes of winch to be used determination control and number of turns determination control in the crane according to one embodiment of the present invention.

As shown in FIG. 11, in Step S100, control apparatus 54 starts winch to be used determination control A. Then, control apparatus 54 advances the process to Step S110 (see FIG. 12). Upon termination of winch to be used determination control A, control apparatus 54 advances the process proceeds to step S200.

In Step S200, control apparatus 54 determines whether or not the setting of work type WT has been determined to be correct during winch to be used determination control A.

Consequently, if it is determined that the setting of work type WT is correct during winch to be used determination control A, control apparatus 54 advances the process to Step S300.

In contrast, if it is determined that the setting of work type WT is incorrect during winch to be used determination control A, that is, if it is determined that the setting of work type WT is erroneous, control apparatus 54 advances the process to Step S100.

Figure 12:
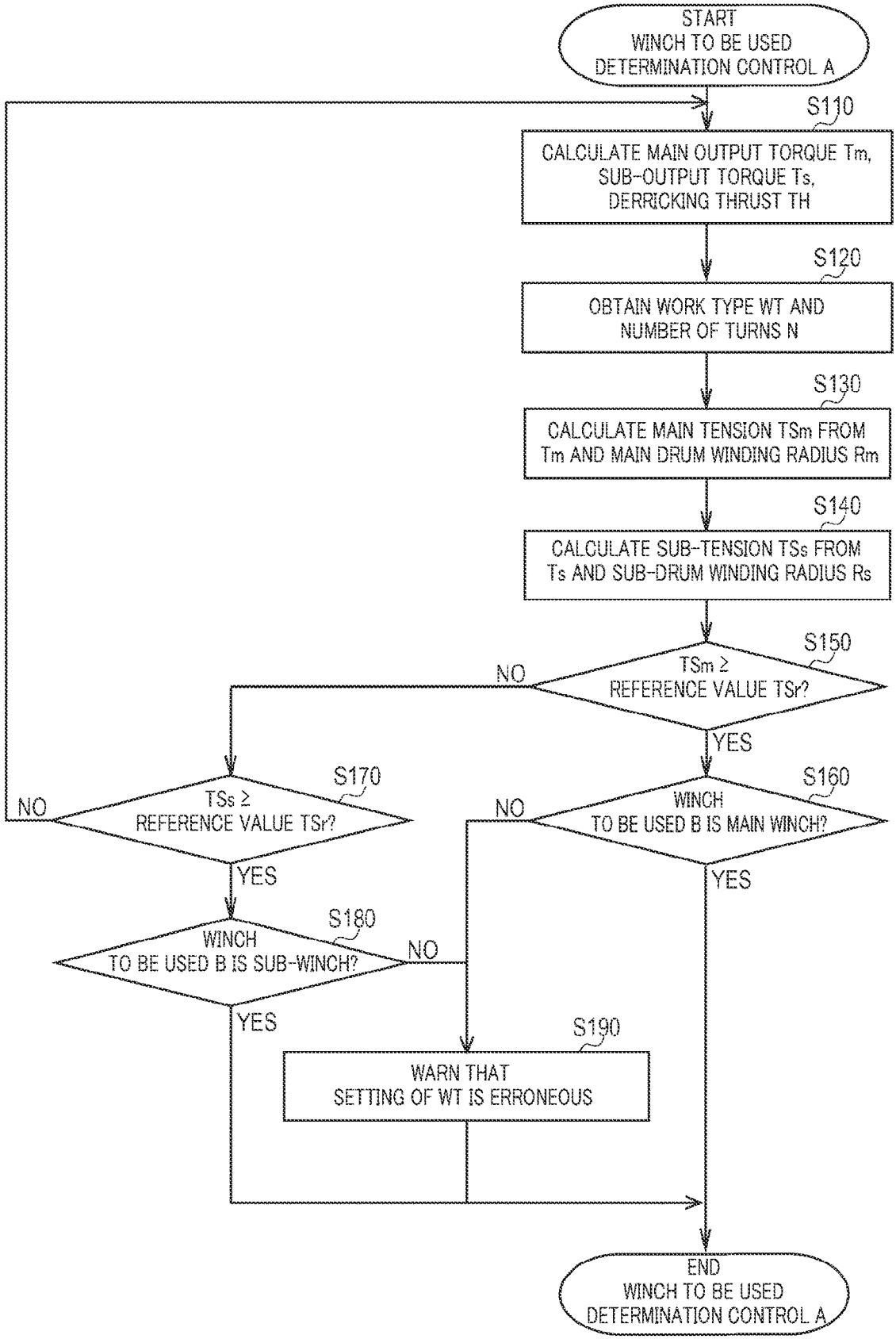
FIG. 12 is a flow chart showing control modes of winch to be used determination control and number of turns determination control in the crane according to one embodiment of the present invention.

As shown in FIG. 12, in Step S110 of winch to be used determination control A, control apparatus 54 calculates main output torque Tm, sub-output torque Ts, and derricking thrust TH. Control apparatus 54 advances the process to Step S120.

In Step S120, control apparatus 54 obtains work type WT and number of turns N set through safety apparatus 23. Control apparatus 54 advances the process to Step S130.

In Step S130, control apparatus 54 calculates main tension TSm based on the calculated main output torque Tm of main winch 17 and the determined main drum winding radius Rm Control apparatus 54 advances the process to Step S140.

In Step S140, control apparatus 54 calculates sub-tension TSs based on the calculated sub-output torque Ts of sub-winch 18 and the determined sub-drum winding radius Rs. Control apparatus 54 advances the process to Step S150.

In Step S150, control apparatus 54 determines whether or not the calculated main tension TSm is greater than or equal to reference value TSr which is a tension value at which object W is regarded as being lifted.

Consequently, if it is determined that main tension TSm is greater than or equal to reference value TSr which is a tension value at which object W is regarded as being lifted, control apparatus 54 advances the process to Step S160.

In contrast, if it is determined that main tension TSm is less than reference value TSr which is a tension value at which object W is regarded as being lifted, control apparatus 54 advances the process to Step S170.

In Step S160, control apparatus 54 determines whether or not winch B is main winch 17.

Figure 13:
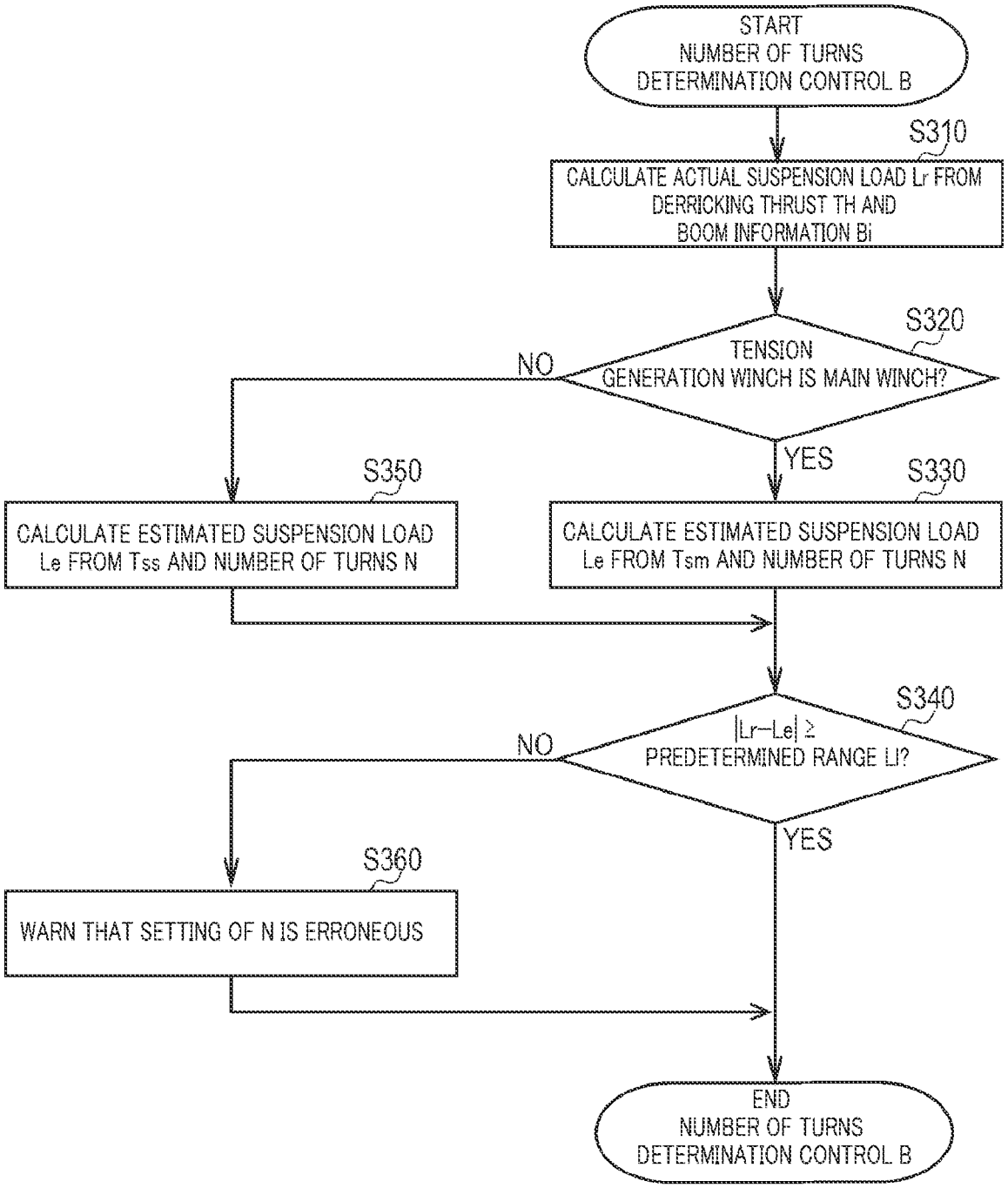
FIG. 13 is a flow chart showing a control mode of number of turns determination control in the crane according to one embodiment of the present invention.

Consequently, if it is determined that winch B is main winch 17, that is, if it is determined that the setting of work type WT in safety apparatus 23 is correct, control apparatus 54 terminates winch to be used determination control A and advances the process to Step 200 and then Step S300 (see FIG. 13).

In contrast, if it is determined that winch B is not main winch 17, that is, if it is determined that the setting of work type WT in safety apparatus 23 is erroneous, control apparatus 54 advances the process to Step S190.

In Step S170, control apparatus 54 determines whether or not the calculated sub-tension TSs is greater than or equal to reference value TSr which is a tension value at which object W is regarded as being lifted.

Consequently, if it is determined that sub-tension TSs is greater than or equal to reference value TSr which is a tension value at which object W is regarded as being lifted, control apparatus 54 advances the process to Step S180.

In contrast, if it is determined that sub-tension TSs is less than reference value TSr which is a tension value at which object W is regarded as being lifted, control apparatus 54 advances the process to Step S110.

In Step S180, control apparatus 54 determines whether or not winch B is sub-winch 18.

Consequently, if it is determined that winch B is sub-winch 18, that is, if it is determined that the setting of work type WT in safety apparatus 23 is correct, control apparatus 54 terminates winch to be used determination control A and advances the process to Step 200 and then Step S300 (see FIG. 13).

In contrast, if it is determined that winch B is not sub-winch 18, that is, if it is determined that the setting of work type WT in safety apparatus 23 is erroneous, control apparatus 54 advances the process to Step S190.

In Step S190, control apparatus 54 informs the operator of the warning that the setting of work type WT is erroneous through safety apparatus 23, and control apparatus 54 terminates winch to be used determination control A and advances the process to Step 200 and then Step S100 (see FIG. 11).

As shown in FIG. 13, in Step S310 of number of turns determination control B, control apparatus 54 calculates actual suspension load Lr based on boom information Bi and the calculated derricking thrust TH. Control apparatus 54 advances the process to Step S320.

In Step S320, control apparatus 54 determines whether or not winch A is main winch 17.

Consequently, if it is determined that winch A is main winch 17, control apparatus 54 advances the process to Step S330.

In contrast, if it is determined that winch A is not main winch 17, that is, if it is determined that winch A is sub-winch 18, control apparatus 54 advances the process to Step S350.

In Step S330, control apparatus 54 calculates estimated suspension load Le based on the calculated main tension TSm and number of turns N. Control apparatus 54 advances the process to Step S340.

In Step S340, control apparatus 54 determines whether or not a difference between the calculated estimated suspension load Le and actual suspension load Lr is within predetermined range Ll.

Consequently, if it is determined that the difference between the calculated estimated suspension load Le and actual suspension load Lr is within predetermined range Ll, that is, if it is determined that the setting of number of turns N in safety apparatus 23 is correct, control apparatus 54 terminates number of turns determination control B. Control apparatus 54 advances the process to Step S100.

In contrast, if it is determined that the difference between the calculated estimated suspension load Le and actual suspension load Lr is out of predetermined range Ll, that is, if it is determined that the setting of number of turns N in safety apparatus 23 is erroneous, control apparatus 54 advances the process to Step S360.

In Step S350, control apparatus 54 calculates estimated suspension load Le based on the calculated sub-tension TSs and number of turns N (in this embodiment, N=1). Control apparatus 54 advances the process to Step S340.

In Step S360, control apparatus 54 displays the warning that the setting of number of turns N is erroneous, on the display screen of safety apparatus 23, terminates number of turns determination control B. Control apparatus 54 advances the process to Step S100.

With such a configuration, in crane 1 with a plurality of winches, the suitability of work type WT set in safety apparatus 23 is quickly determined according to the mode of the operation of crane 1 by the operator. Further, crane 1 performs a comparison between estimated suspension load Le calculated based on number of turns N set in safety apparatus 23 and actual suspension load Lr calculated from derricking thrust TH, thereby determining the suitability of work type WT and number of turns N set in safety apparatus 23. In other words, in crane 1, a comparison between estimated suspension load Le calculated based on a set value input to safety apparatus 23 by the operator and actual suspension load Lr calculated based on the actual weight of object W determines whether or not there is an erroneous setting in safety apparatus 23. In this case, in crane 1, estimated suspension load Le is calculated based on main output torque Tm of main hydraulic motor 17A or sub-output torque Ts of sub-hydraulic motor 18A. In other words, estimated suspension load Le calculated in crane 1 according to this embodiment is estimated suspension load Le containing a load caused, for example, by friction between a wire rope and a sheave. In contrast, in a conventional crane in which a tensiometer is provided in the middle of a wire rope in the vicinity of a hook block, an estimated suspension load is calculated based only on the weight of an object measured by the tensiometer. Accordingly, crane 1 allows the operator to recognize, through safety apparatus 23, that a setting in safety apparatus 23 is erroneous based on a value more appropriately reflecting the state of the load on the wire rope.

Next, with reference to FIG. 14, another embodiment of determination of an erroneous setting in safety apparatus 23 will be described in detail. In the following embodiment, detailed descriptions of the same points as those of the previously described embodiments will be omitted, and differences will be mainly described. This embodiment is different in that only main winch 17 is provided in crane 1.

Figure 14:
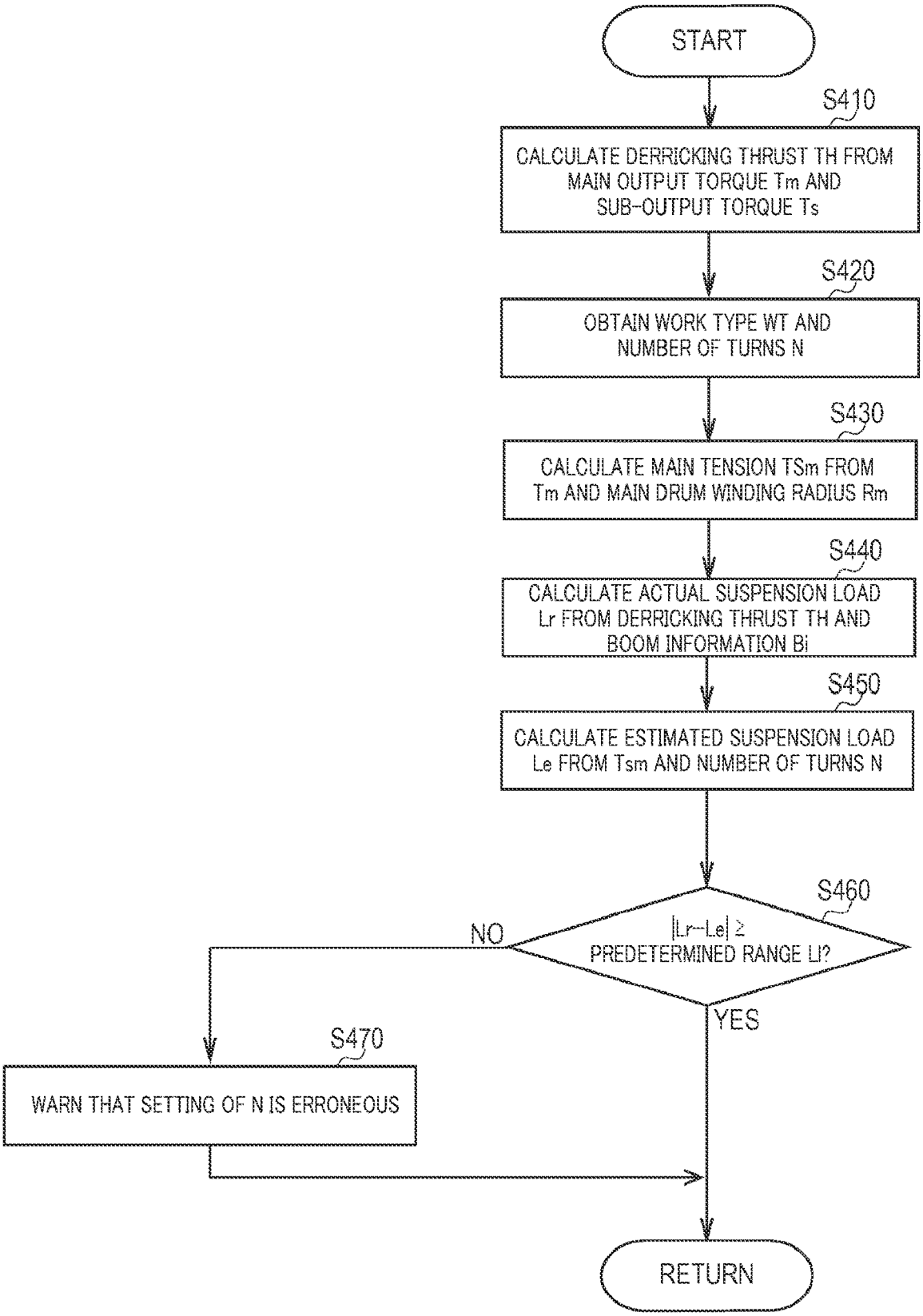
FIG. 14 is a flow chart showing a control mode of number of turns determination control in a crane with only a main winch, according to the other embodiment of the present invention.

As shown in FIG. 14, Steps S410 to S430 are the same as Steps S110 to S130 in winch to be used determination control A shown in FIG. 12 and the description thereof will therefore be omitted.

Steps S440 to S470 are the same as Step S310, Step S330, Step S340, and Step S360 in number of turns determination control B shown in FIG. 13 and the description thereof will therefore be omitted.

With such a configuration, crane 1 performs a comparison between estimated suspension load Le calculated based on number of turns N set in safety apparatus 23 and actual suspension load Lr calculated from derricking thrust TH, thereby determining the suitability of work type WT and number of turns N set in safety apparatus 23. In other words, in crane 1, a comparison between estimated suspension load Le calculated based on a set value input to safety apparatus 23 by the operator and actual suspension load Lr calculated based on the actual weight of object W determines whether or not there is an erroneous setting in safety apparatus 23. Thus, the operator can recognize through safety apparatus 23 that work type WT set in safety apparatus 23 is erroneous.

Although the above-described crane 1, which is one embodiment of crane, has a configuration including main winch 17 and sub-winch 18 or a configuration including only main winch 17, this is not necessarily the case, and it is only required that crane 1 includes one or more winches. Although crane 1 has been described assuming that object W is suspended by telescoping boom 8, this is not necessarily the case and object W may be suspended on jib 13 attached to telescoping boom 8. The above-described embodiment is mere illustration of a representative mode, and various modifications can be implemented without departing from the spirit of one embodiment. It is natural that it can be implemented in various other modes, the scope of the present invention is indicated by Claims, and equivalents and all modifications of the Claims should be included in the scope of the present invention.

INDUSTRIAL APPLICABILITY

The present invention is applicable to a crane.

REFERENCE SIGNS LIST

1 Crane
17 Main winch
18 Sub-winch
19 Main wire rope
20 Sub-wire rope
23 Safety apparatus
Tm Main output torque
Ts Sub-output torque
TSm Main tension
TSs Sub-tension
TSr Reference value

The invention claimed is:

1. A crane, comprising:

a plurality of hydraulic winches;

wire ropes that are drawn in and out from the plurality of hydraulic winches and are suspended on a sheave of a boom to be derricked with a hydraulic cylinder or a sheave of a jib provided to a distal end section of the boom;

a safety apparatus that sets a hydraulic winch to be used among the plurality of hydraulic winches and a number of turns of the wire rope drawn in and out from the hydraulic winch to be used; and, a control apparatus that calculates tensions of the wire ropes from output torques of the plurality of hydraulic winches and winding radiuses of the wire ropes wound around the plurality of hydraulic winches, and that determines a setting in the safety apparatus is erroneous, when the tension of the wire rope wound around a hydraulic winch different from the hydraulic winch to be used set in the safety apparatus is greater than or equal to a reference value.

2. The crane according to claim 1, wherein the control apparatus calculates an estimated suspension load from the number of turns of the wire rope drawn in and out from the hydraulic winch to be used set in the safety apparatus and the tension of the wire rope, the control apparatus calculates an actual suspension load from a thrust of the hydraulic cylinder and a shape and attitude of the boom or shapes and attitudes of the boom and the jib, and the control apparatus determines that a setting in the safety apparatus is erroneous, when a difference between the estimated suspension load and the actual suspension load is out of a predetermined range.

3. The crane according to claim 2, wherein a torque of the hydraulic winch is calculated from a hydraulic pressure in a draw-in side part of the hydraulic winch and a hydraulic pressure in a draw-out side part of the hydraulic winch, and a thrust of the hydraulic cylinder is calculated from a hydraulic pressure in a head side oil chamber of the hydraulic cylinder and a hydraulic pressure in a rod side oil chamber of the hydraulic cylinder.

4. The crane according to claim 1, wherein, when determining that a setting in the safety apparatus is erroneous, the control apparatus informs of an error in the setting or a content of the error in the setting.

5. A crane, comprising:

a hydraulic winch;

a wire rope that is drawn in and out from the hydraulic winch and is suspended on a sheave of a boom to be derricked with a hydraulic cylinder or a sheave of a jib provided to a distal end section of the boom;

a safety apparatus that sets a number of turns of the wire rope drawn in and out from the hydraulic winch; and, a control apparatus that calculates a tension of the wire rope from an output torque of the hydraulic winch and a winding radius of the wire rope wound around the hydraulic winch, wherein the control apparatus calculates an estimated suspension load from the number of turns of the wire rope set in the safety apparatus and the tension of the wire rope, the control apparatus calculates an actual suspension load from a thrust of the hydraulic cylinder and a shape and attitude of the boom or shapes and attitudes of the boom and the jib, and the control apparatus determines that a setting in the safety apparatus is erroneous, when a difference between the estimated suspension load and the actual suspension load is out of a predetermined range.

* * * * *